US006896137B2

(12) United States Patent
McHutchinson

(10) Patent No.: US 6,896,137 B2
(45) Date of Patent: May 24, 2005

(54) TAMPER PROOF SLIDE COVER CONTAINER

(75) Inventor: Roy Neil McHutchinson, South Perth (AU)

(73) Assignee: In-Vivo Systems Limited, Norwich (GB)

( * ) Notice: Subject to any disclaimer, the term of this patent is extended or adjusted under 35 U.S.C. 154(b) by 43 days.

(21) Appl. No.: 10/088,181

(22) PCT Filed: Jul. 13, 2001

(86) PCT No.: PCT/AU01/00844

§ 371 (c)(1),
(2), (4) Date: Jul. 15, 2003

(87) PCT Pub. No.: WO02/06135

PCT Pub. Date: Jan. 24, 2002

(65) Prior Publication Data

US 2004/0020926 A1 Feb. 5, 2004

(30) Foreign Application Priority Data

Jul. 14, 2000 (AU) ..... PQ8762

(51) Int. Cl.[7] ..... B65D 83/04
(52) U.S. Cl. ..... 206/528; 206/807
(58) Field of Search ..... 206/528, 531, 206/532, 538, 69, 440, 807; 229/102, 125.125

(56) References Cited

U.S. PATENT DOCUMENTS 4,787,526 A 11/1988 Pehr
5,285,918 A * 2/1994 Weisburn et al. ..... 206/807
5,878,887 A * 3/1999 Parker et al. ..... 206/528
5,931,291 A * 8/1999 Sedon et al. ..... 206/807

FOREIGN PATENT DOCUMENTS

| | | |
|---|---|---|
| EP | 0 284 509 | 9/1988 |
| EP | 0 658 486 | 6/1995 |
| GB | 2 081 228 | 2/1982 |
| GB | 2 219 284 | 6/1989 |
| WO | WO 90/14999 | 12/1990 |
| WO | WO 99/10249 | 3/1999 |

* cited by examiner

*Primary Examiner*—Luan K. Bui
(74) *Attorney, Agent, or Firm*—Merchant & Gould P.C.

(57) ABSTRACT

A tamper proof container comprising: a container body (1) within which product can be accommodated, the container body having an access opening (7); a cover (9) separable from the container body for closing the access opening and including engagement means (37, 43) for engaging the container body when over the access opening; and tamper prevention means (11) for preventing removal of the cover when located over the access opening, the tamper prevention means including at least one locking element (15); wherein the locking element(s) is adapted to allow an initial engagement of the cover to the container body over the access opening while preventing subsequent removal therefrom; and wherein the locking element(s) is separable from the container, the separation of the locking element(s) allowing the removal of the cover from the container body, the removal of the locking element(s) further providing a visual indication that the container has been opened.

20 Claims, 21 Drawing Sheets

FIG 22
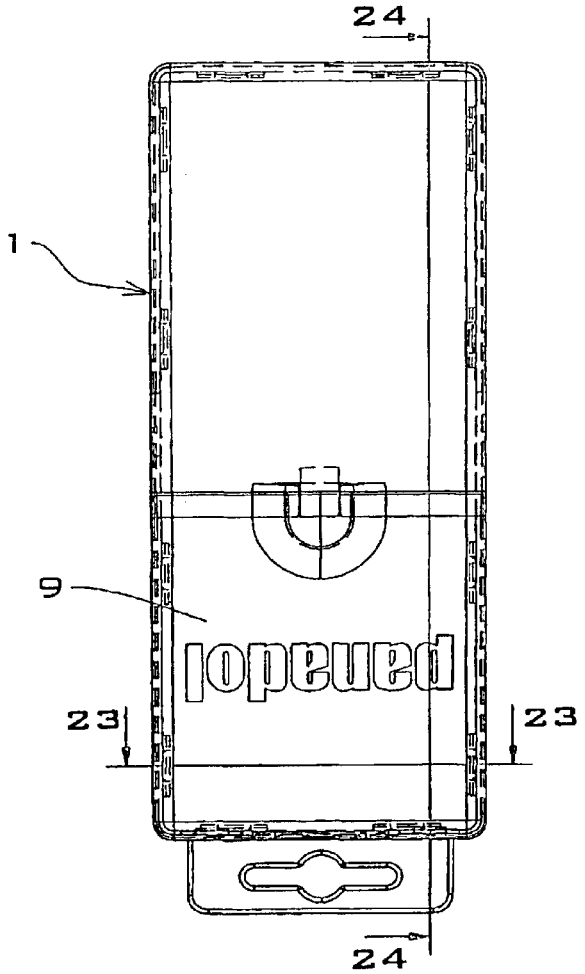
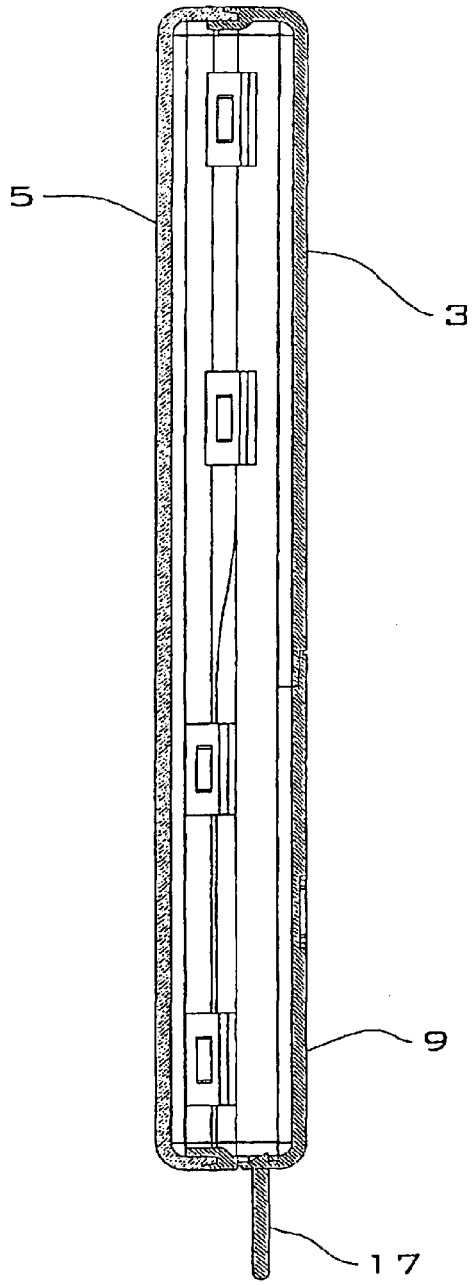
FIG 24
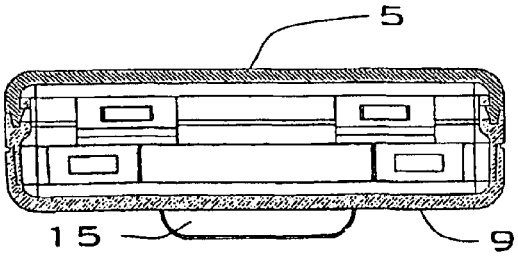
FIG 23

1
9

58

58

9

15
9

15
9

1
9
62
63
64
68
70
71
72

TAMPER PROOF SLIDE COVER CONTAINER

The present invention is generally directed to containers for storing products, and in particular to a container having tamper prevention features. Although the present invention will be described with respect to the packaging of medical or hygiene products such as drug capsules or tablets, condoms or tampons and band aids, it is to be appreciated that the present invention is not restricted to this application and that other uses are also envisaged.

Products of the above mentioned type are commonly sold in cardboard cartons. These cartons can be covered by heat wrapped plastic sheeting to afford a limited degree of tamper prevention by preventing the opening of the carton to gain access to the contents without tearing of the plastic wrapping. The tearing of the wrapping provides a visual indication that the packaging has been opened. This type of wrapping does not however prevent a more malicious form of tampering where the products are dosed with foreign substances such as poison by using a syringe needle. The hole produced by the needle can be located to escape notice so that the tampering of the product remains undetected.

Although such malicious tampering could be overcome by enclosing the product in a heat welded hard plastic casing, it has until now been uneconomical to do so as it would add significantly to the overall selling cost of the product. Also, such a hard casing could well be difficult to open by the final end user of the product.

It is therefore an object of the present invention to provide a tamper proof container for protecting any product stored within from the type of malicious tampering referred to above.

It is another object of the present invention to provide a tamper proof container that provides a visual indication of the container having been opened.

It is a further object of the present invention to provide a tamper proof container that is relatively economical to manufacture, and is also relatively easy to open by the end user.

With this in mind, according to the present invention, there is provided a tamper proof container comprising:

- a container body within which product can be accommodated, the container body having an access opening;
- a cover separable from the container body for closing the access opening and including engagement means for engaging the container body when over the access opening; and
- tamper prevention means for preventing removal of the cover when located over the access opening, the tamper prevention means including at least one locking element;
- wherein the locking element(s) is adapted to allow an initial engagement of the cover to the container body over the access opening while preventing subsequent removal therefrom;
- and wherein the locking element(s) is separable from the container, the separation of the locking element(s) allowing the removal of the cover from the container body, the removal of the locking element(s) further providing a visual indication that the container has been opened.

A tamper proof container according to the present invention can be filled with product through the access opening, the cover being subsequently installed over the access opening and prevented from subsequent removal by the tamper prevention means. It is however also envisaged that the tamper proof container could be filled with product during assembly of the container.

The access opening may be provided in a wall(s) of the container body, and the engagement means of the cover may provide a releasable engagement of the cover to the container body when located over the access opening. The cover may be at least substantially flush with the wall(s) when engaged with the container body. This provides a relatively smooth profile for the container when closed giving it a visually pleasing appearance.

According to a first preferred embodiment of the present invention, the cover may be in the form of a slide cover slidably supportable over the access opening. The slide cover may include a peripheral lip extending along at least a portion of the periphery thereof. The peripheral lip may be adapted to engage a cooperating shoulder or channel in the container body located adjacent to the access opening to allow sliding motion of the slide cover relative to the access opening. The engagement means for the slide cover may include one or more tungs located at one end of the slide cover, the or each tung respectively engaging a cooperating lug on the container body. This lug may be provided on an internal surface of the container body adjacent the access opening. The engagement means of the slide cover may also include one or more lugs and one or more cooperating apertures respectively provided on an inner face of the peripheral lip of the cover at an opposing end of the slide cover to the tung(s) or in the container body adjacent the access opening, the lug(s) being accommodated within the aperture when the slide cover completely closes the access opening. The cooperating tung(s) and lug(s) on one end of the cover acts to hold that end of the slide cover in position, and the cooperating lug(s) and aperture(s) on the other end of the slide cover acts to prevent the lifting of that end away from the access opening. It should be appreciated that other engagement means for the slide cover are also envisaged. The use of a cover having a peripheral lip engaging a cooperating shoulder ensures that there is no ready access for a hypodermic syringe at the junction between the cover and the container body.

The locking element of the tamper prevention means may include a locking tab extending from the container body adjacent the access opening. The locking tab may extend at least substantially perpendicular relative to the plane of the access opening thereby preventing separation of the slide cover from the container body. The locking tab may attached to the rest of the container body by a frangible connection portion thereof. The locking tab may be integrally formed with the container body with a relatively thin wall section between the locking tab and the rest of the container wall to provide the frangible connection portion for the locking tab. The locking tab may include a contact face located on a side of the locking tab facing the access opening. The contact face may be inclined at an acute angle relative to the plane of the access opening. The purpose of the inclined face will be subsequently described. A hanging hook or web having a hanging hole may also extend from the locking tab.

According to the second preferred embodiment of the present invention, the engagement means for the cover may include a peripheral rib extending along at least a portion of the periphery of the cover, the peripheral rib being locatable within a cooperating groove in the container body. This arrangement helps to make it even more difficult to insert a needle between the cover and the container body while at the same time helping to hold the cover in position over the access opening.

The engagement means of the cover may further include one or more tags extending from an inner face of the cover, said tag(s) forming part of a coupling arrangement for engaging the cover to the container body. An aperture may be provided in the tag(s) for engaging a cooperating lug provided within the container body as another part of the coupling arrangement. The lug(s) may be resiliently biased and supported on a manual actuator mechanism for allowing the release of the lug(s) from the cooperating tag(s) thereby allowing the removal of the cover from the container body. The lug(s) may be mounted on a part of the manual actuator mechanism. The manual actuator mechanism may include a biased latch, whereby movement of the latch disengages the coupling arrangement.

The locking element of the tamper prevention means may be provided on the cover, the locking element preventing movement of the latch thereby preventing the release of the cover from the container body. The locking element may include a locking tab located immediately adjacent the latch, the locking tab being connected to the cover by a frangible connection. The locking tab may be integrally formed with the cover with a relatively thin wall section between the locking tab and the rest of the cover to provide a frangible connection portion for the locking tab.

The container body may be of any shape depending on the type of product to be accommodated. For example, the container body may be rectangular or square in shape when seen in plan view and may having a relatively narrow profile when seen from the side. Such a container body would be appropriate for flat products such as blister packed tablets or capsules or flat packed condoms. Other container shapes are however envisaged. For example, the container could also be round, or a pentagon or hexagon shape when seen in plan view.

The container body may be manufactured in two or more sections and subsequently assembled. To this end, each section may include cooperating coupling means to facilitate this assembly. According to an example arrangement according to the present invention, the container body may be made of two separate casing shells. A series of female snap tungs may be provided along the peripheral edge of one casing shell, and a series of cooperating male lugs may be provided adjacent the peripheral edge of the other casing shell to enable a "snap clip" non-removal connection between the casing shells. The two casing shells can then be assembled by bringing the two casing shells together such that the female tungs and male lugs are engaged. A rib may be provided along the peripheral edge of one of the casing shells, and a cooperating shoulder or channel may be provided along the peripheral edge of the other casing shell. When the two casing shells are brought together, the rib can be accommodated by the shoulder or rib. This prevents the ready access of a hypodermic needle at the junction between the two casing shells.

The container body and cover should be made of a material that is relatively rigid. This helps to prevent gaps being formed at the junction between the sections of the container body and/or the cover and the container body due to deformation of the container body by pressure being applied thereon. The material should also enable the locking tab to be separated from and the container body at the frangible connection thereof. Suitable material include relatively rigid material such as ABS plastic.

It is also envisaged that the container body sections could alternatively be ultrasonically welded or glued together to eliminate any junctions. It is however general preferable to use a joining arrangement as described above as this can facilitate automatic assembly of the container reducing the production time and costs of the container.

The locking tab in the first preferred embodiment according to the present invention operates in the following manner.

The slide cover can be initially fitted to the container body when the locking tab is in position. The slide cover is initially engaged by the tung(s) at one end of the slide cover to the container body over the access opening, with the slide cover being positioned at an angle to the plane of the access opening. The other end of the slide cover will initially abut against the inclined face of the locking tab. The frangible connection portion of the locking tab is sufficiently resilient to allow for some deflection of the locking tab. The slide cover can therefore be displaced towards the access opening in a pivotal movement about the engaged end of the slide cover, the other end abutting the inclined face of the locking tab. The pivotal displacement of the slide cover applies a force on the locking tab resulting in deflection thereof. When the slide cover is in position over the access opening, the other end of the slide cover adjacent the locking tab engages the container body. The locking tab returns to its initial position and blocks any sliding motion of the slide cover that would be required to release the engagement means of the cover and allow the cover to be removed from the container. Any attempt to slide open and remove the slide cover would result in the breaking of the locking tab from the container body.

The end user of the container can gain access to the product stored therein by breaking off the locking tab and sliding open the slide cover to opening the access opening of the container body. The absence of the locking tab provides a clear indication that the container has been opened. Having the hanging hook located on the lock tab which is removed together with that lock tab also helps to provide this visual indication. The slide cover can then operate in the usual manner to close the container for storing the remaining contents therein.

In the above described arrangement, the locking element is removed by a pivot break where the locking element is pivoted about its frangible connection. It is however also envisaged that the arrangement of the container is such that the locking element is broken with a twist or circular break, for example when two sections of the container can pivotally slide relative to each other to open the container.

The locking tab in the second embodiment according to the present invention operates in the following manner.

An opening may be provided in the cover through which the latch of the manual actuator mechanism can be located. The locking tab may be located and form one side of the opening. The cover may be located in a position over the access opening, with the tagss of the cover engaging the cooperating lugs of the manual actuator mechanism. The cover is therefore located in position over the access opening. The bias of the lugs allow the lugs to engage cooperating apertures of the tags. The location of the locking tab however prevents movement of the latch preventing the release of the cover from the container body.

The locking tab must therefore be separated from the rest of the cover before the latch can be moved to release the cover from the container body. The removal of the locking tab provides a visual indication of any tampering of the container. Following the opening of the container, the cover can be retained in position on the container by the manual actuator mechanism.

The tamper proof container according to the present invention is resistant to tampering by the use of hypodermic syringes and cannot be opened without providing a clear visual indication that the container has been opened. The container can however continue to be used as a storage container after opening, with the cover still having engagement means for engaging the cover over the access opening.

It will be convenient to further describe the invention with respect to the accompanying drawings, which illustrate a preferred embodiment of the tamper proof container according to the present invention. Other preferred embodiments of the invention are possible, and consequently, the particularity of the accompanying drawings is not to be understood as superceding the generality of the preceding description of the invention.

In the drawings:

FIG. 22 is a plan view of the tamper proof container of FIG. 14 showing section lines 23—23 and 24—24;

FIG. 23 is a cross-sectional view of the tamper proof container of FIG. 22 taken along line 23—23;

FIG. 24 is a cross-sectional view of the tamper proof container of FIG. 22 taken along line 24—24;

Corresponding features in each of the preferred embodiments of a tamper proof container according to the present invention have been designated with the same reference numeral for clarity reasons.

Figure 1:
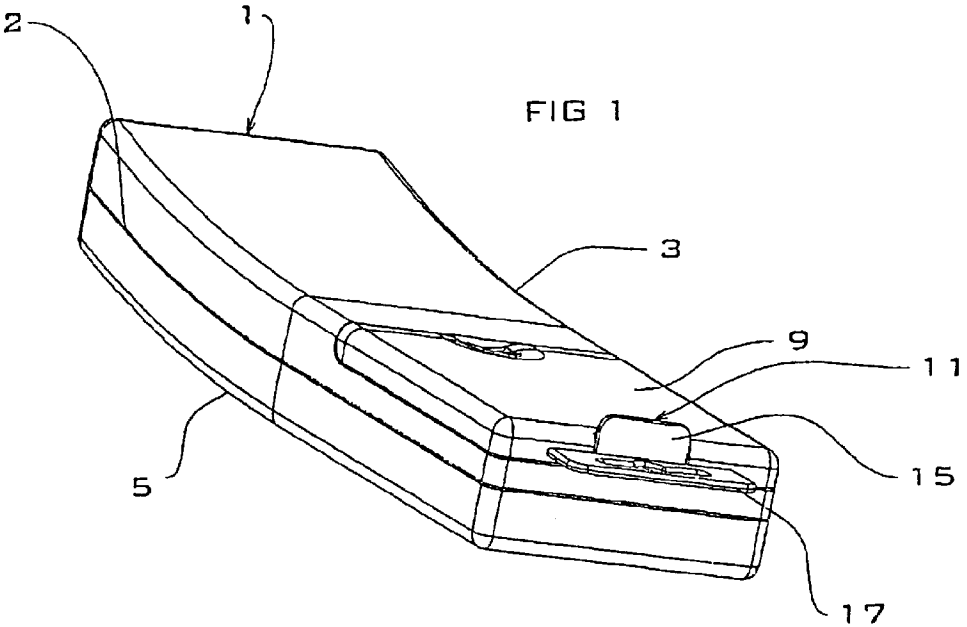
FIG. 1 is an isometric view of a first preferred embodiment of a tamper proof container according to the present invention.
Figure 2:
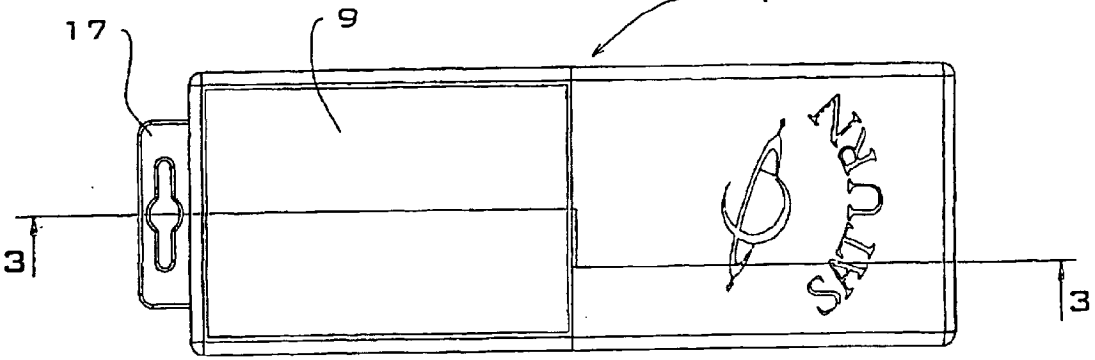
FIG. 2 is a plan view of the tamper proof container of FIG. 1.
Figure 3:
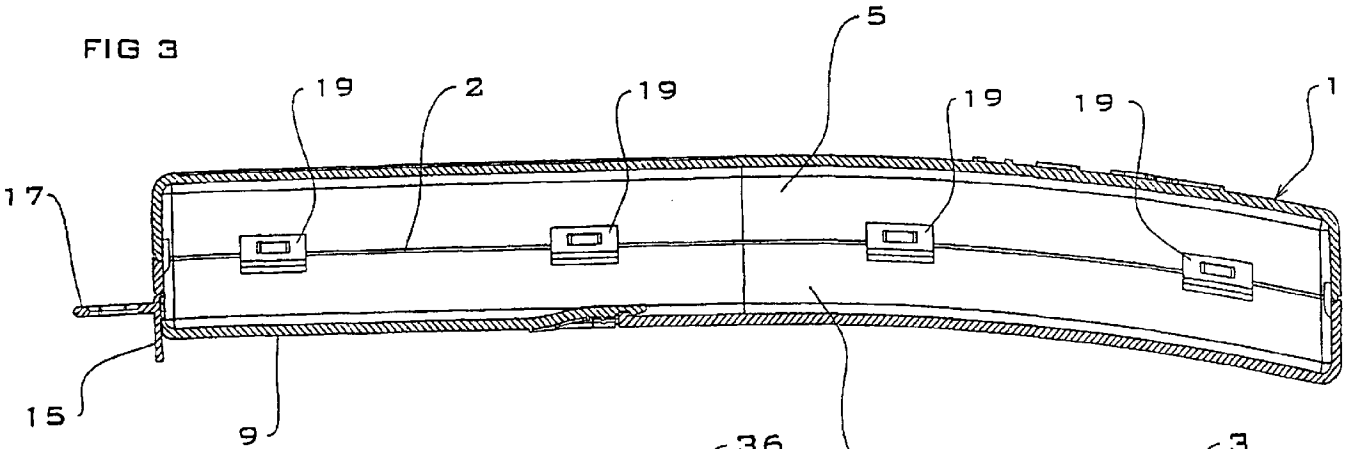
FIG. 3 is a cross sectional view of the tamper proof container of FIG. 1 taken along line 3—3 in FIG. 2.
Figure 4:
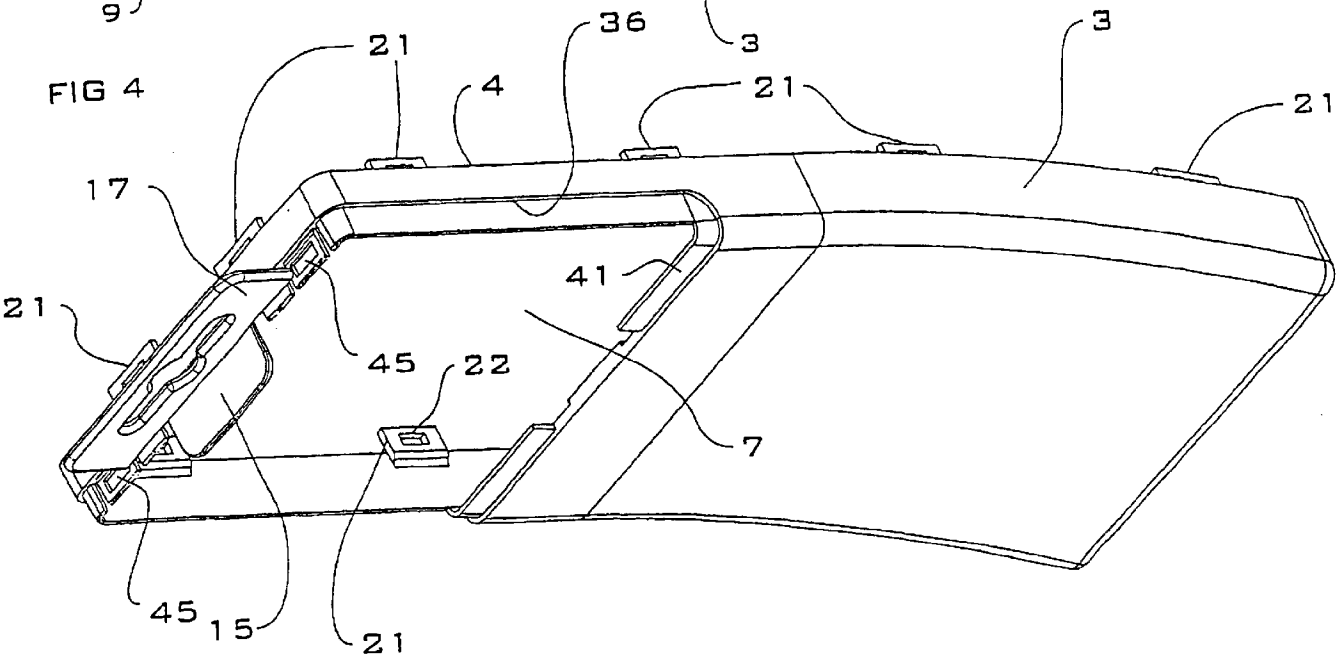
FIG. 4 is an isometric view of a first half casing of the tamper proof container of FIG. 1.
Figure 5:
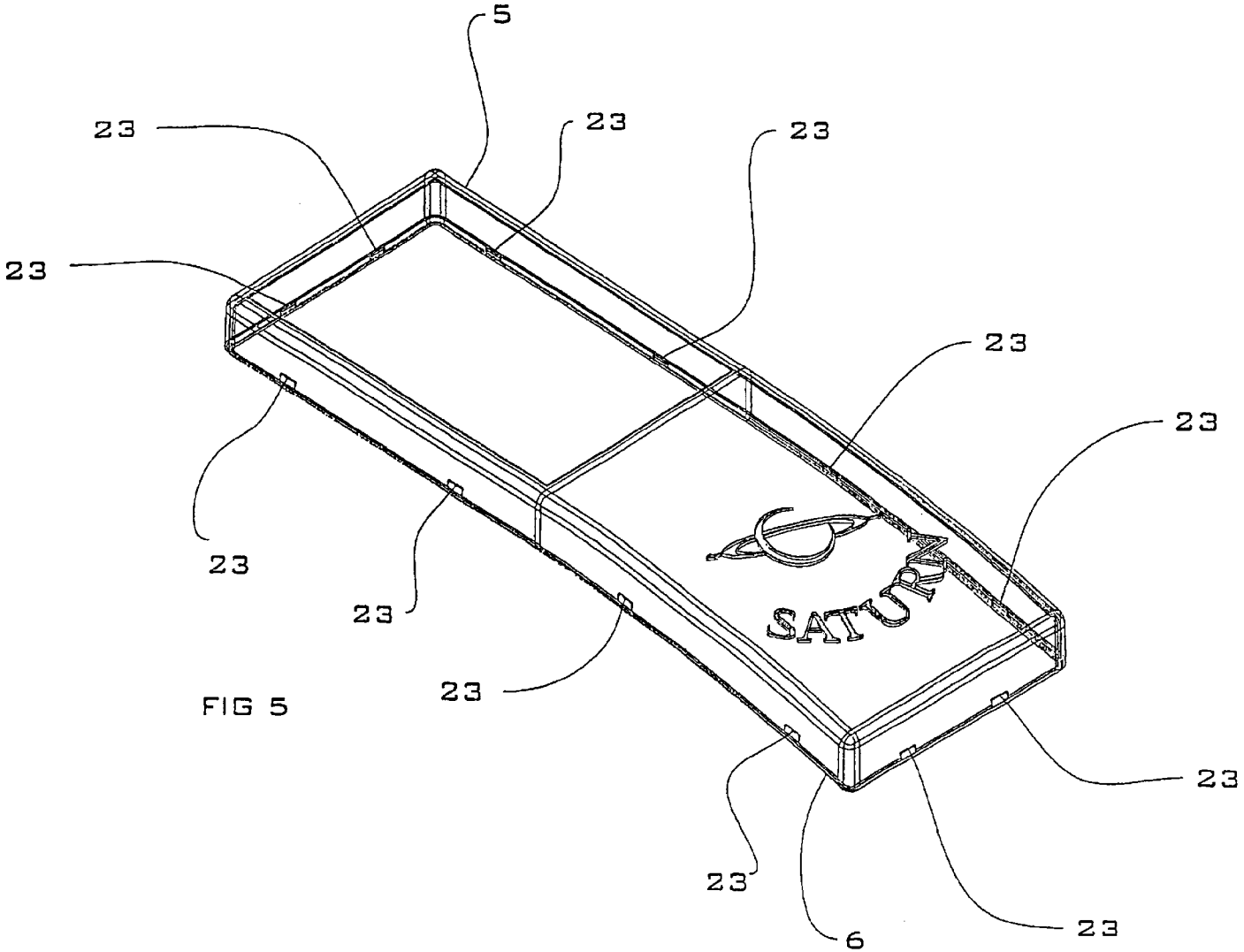
FIG. 5 is an isometric view of a second half casing of the tamper proof container of FIG. 1.
Figures 11, 12:
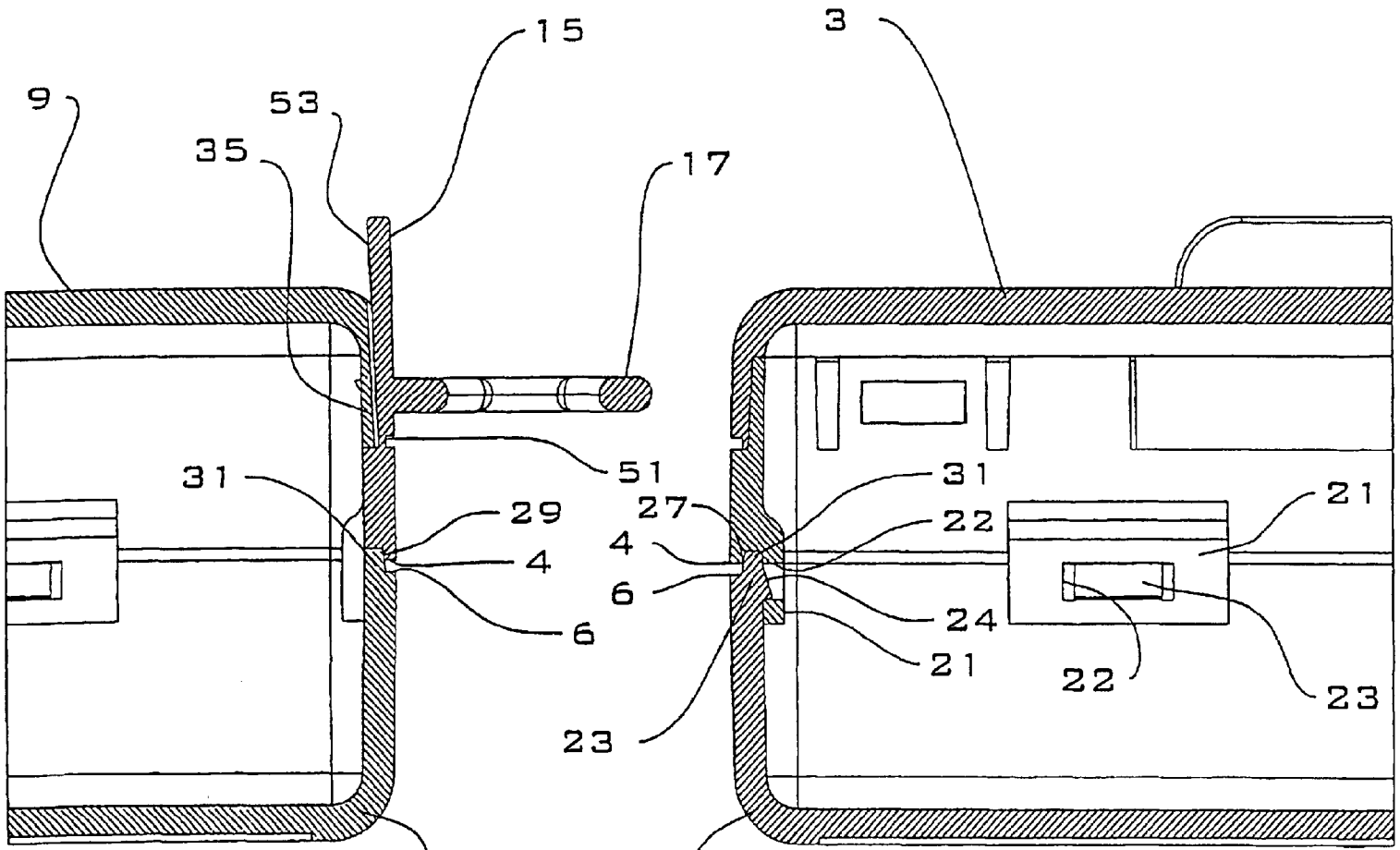
FIG. 11 is a detailed cross sectional view of the tamper prevention means of FIGS. 9 and 10.
FIG. 12 is a detailed view of the snap connection of the first and second half casings as shown in FIGS. 4 and 5.

Referring initially to FIGS. 1 to 5, there is shown a first preferred embodiment of a tamper proof container according the present invention including a container body 1 formed from a first half casing 3 and a second half casing 5. The first half casing 3 includes an access opening 7 for the container body 1. This access opening 7 is closed off by a cover 9, and the tamper proof container further includes tamper prevention means 11 including a locking element 15. A product hanging tag 17 is secured to and forms part of the locking element 15. The first half casing 3 and second half casing 5 are held together by means of a snap connection 19 therebetween as shown in FIG. 3. This snap connection 19 comprises a series of female snap tungs 21 provided along a peripheral edge 4 of the first half casing 3. The snap connection 19 also includes a series of male lugs 23 provided along a peripheral edge 6 of the second half casing 5. When the first and second half casings 3, 5 are brought together, the female snap tungs 21 are deflected over an inclined face 24 of the cooperating male lug 23 until the lug 23 is accommodated within an aperture 22 provided in the female snap tung 21 as best shown in FIG. 12. The peripheral edge 4 of the first half casing 3 includes a groove 27 adjacent each female snap tung 21 or a shoulder 29 at portions of the peripheral edge 6 away from the female snap tungs 21. This groove 27 or shoulder 29 accommodates a rib 31 provided along the peripheral edge 6 of the second half casing 5, as shown in FIGS. 11 and 12. This cooperation between the first half casing peripheral edge 4 and the second half casing peripheral edge 6 helps to prevent the access of a hypodermic syringe through the join line 2 between the half casings.

Figure 6:
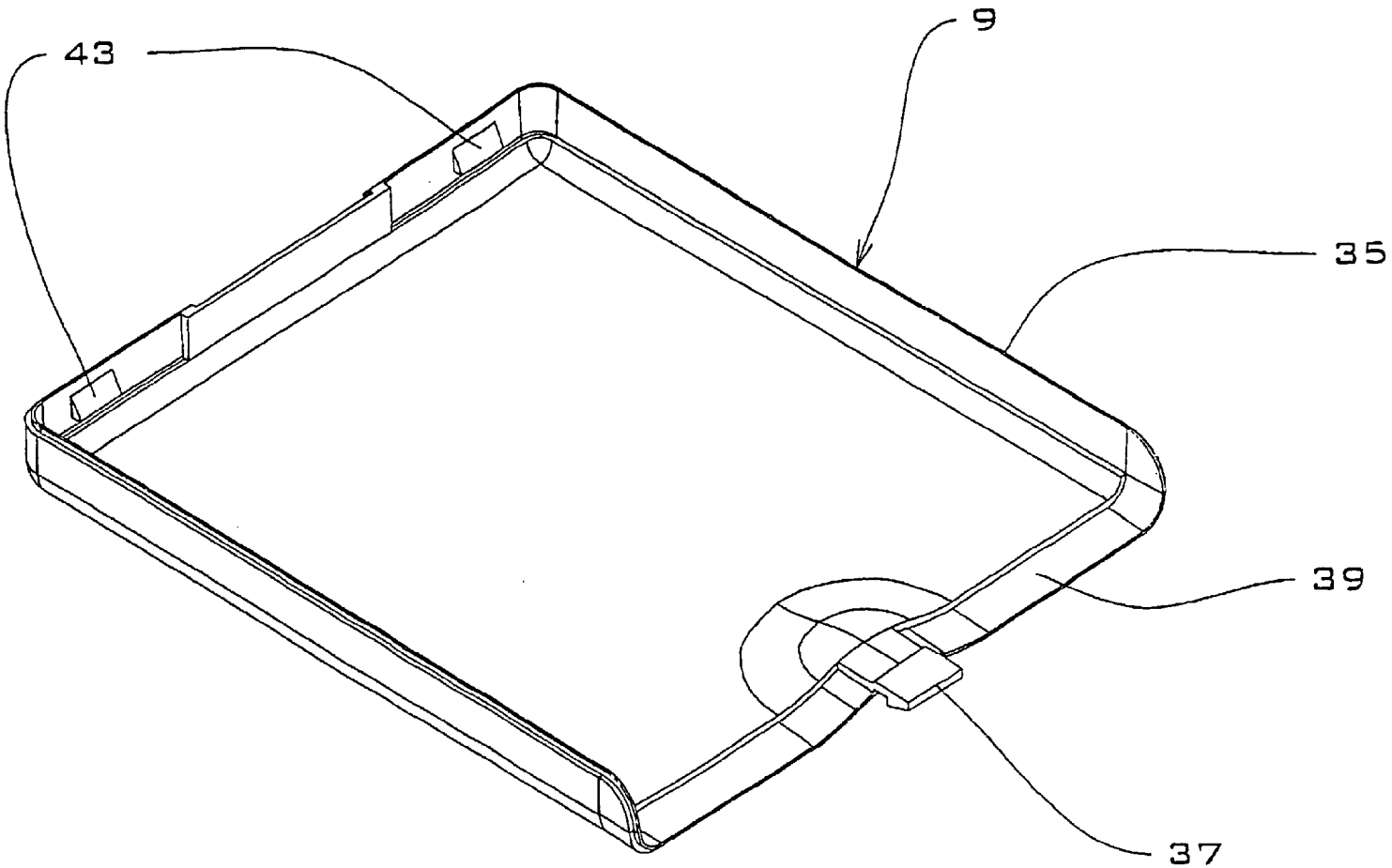
FIG. 6 is an isometric view of a slide cover of the tamper proof container of FIG. 1.

FIG. 6 shows in more detail the features of the slide cover 9 of the tamper proof container. FIG. 6 shows the interior surface of the slide cover 9 which includes a peripheral lip 35 extending along all except one side of the slide cover 9. The retaining side of the slide cover includes an engagement tung 37 for engaging the container body 1. The peripheral lip 35 rests on a shoulder 36 provided about the access opening 7 in the first half casing 3. The retaining side of the slide cover 9 further includes a flange 39 which rests upon a shoulder 41 provided on one end of the access opening 7 of the first half casing 3. The other end of the slide cover 9 opposite to the engagement tung 37 includes two male lugs 43 for engaging cooperating apertures 45 provided on the first half casing 3 adjacent the access opening 7 on either side of the locking element 15.

Figure 7:
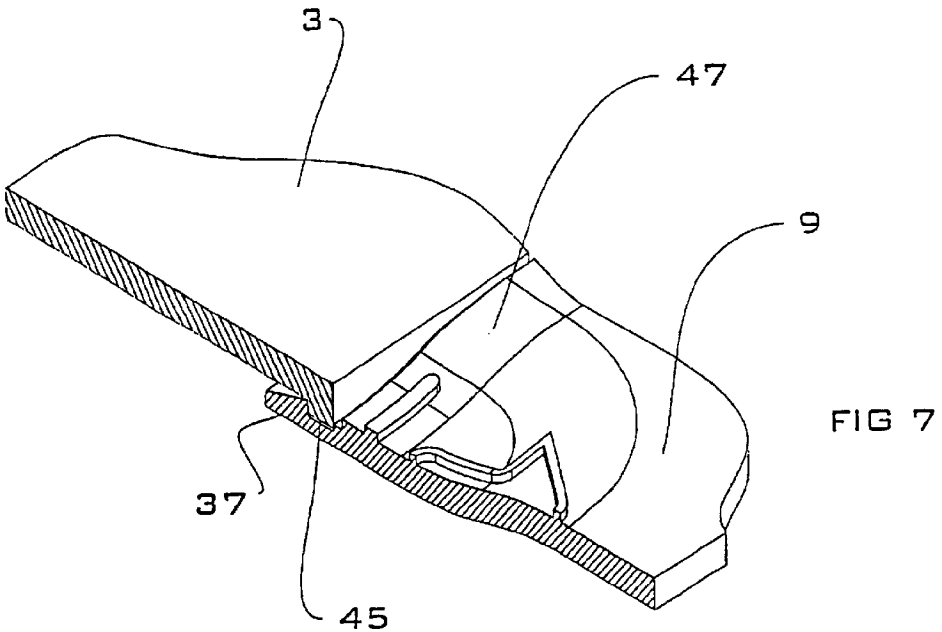
FIGS. 7 and 8 are detailed cross sectional view showing the engagement of the slide cover to the container body of the tamper proof container of FIG. 1.
Figure 8:
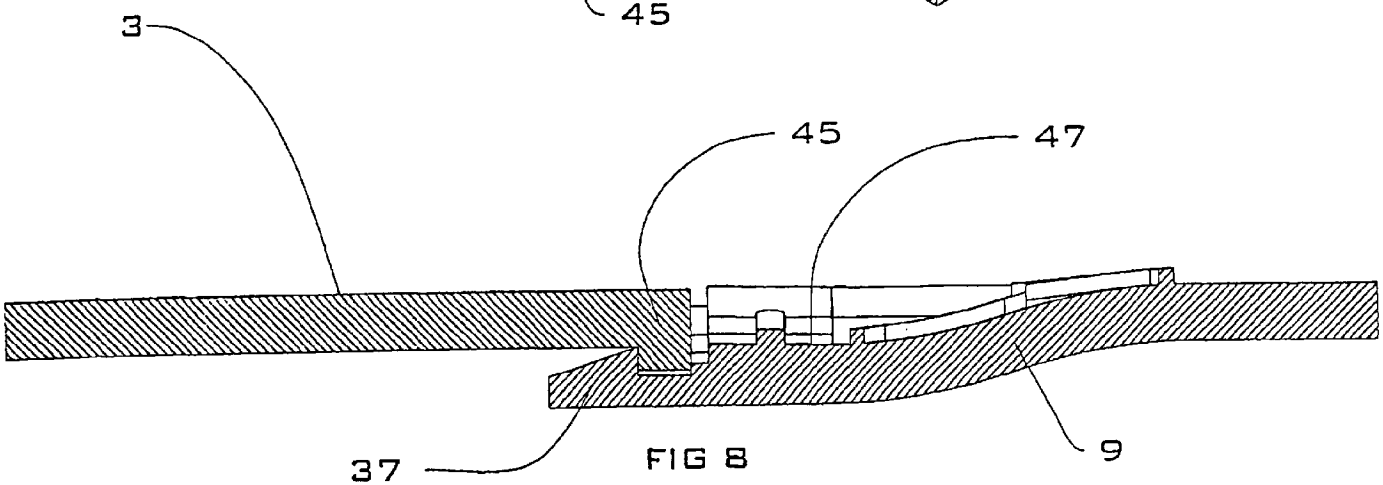

FIGS. 7 and 8 show how the cover 9 engages the first half casing 3 immediately adjacent the access opening 7. A cooperating lug 45 is provided on an interior surface of the first half casing 3 adjacent the access opening 7. A finger depression 47 is provided on the cover 9 adjacent to the engagement tung 37.

The cooperation of the engagement tung 37 and the cooperating lug 45 serves two functions. Firstly, they provide a pivot point about which the slide cover 9 can rotate when it is initially installed on to the container body 1 over the access opening 7. Secondly, they act to retain the slide cover 9 over the access opening 7. The slide cover 9 is further retained over the access opening 7 by the cooperation of the lugs 43 with the apertures 45 at the opposing end of the cover 9.

Figure 9:
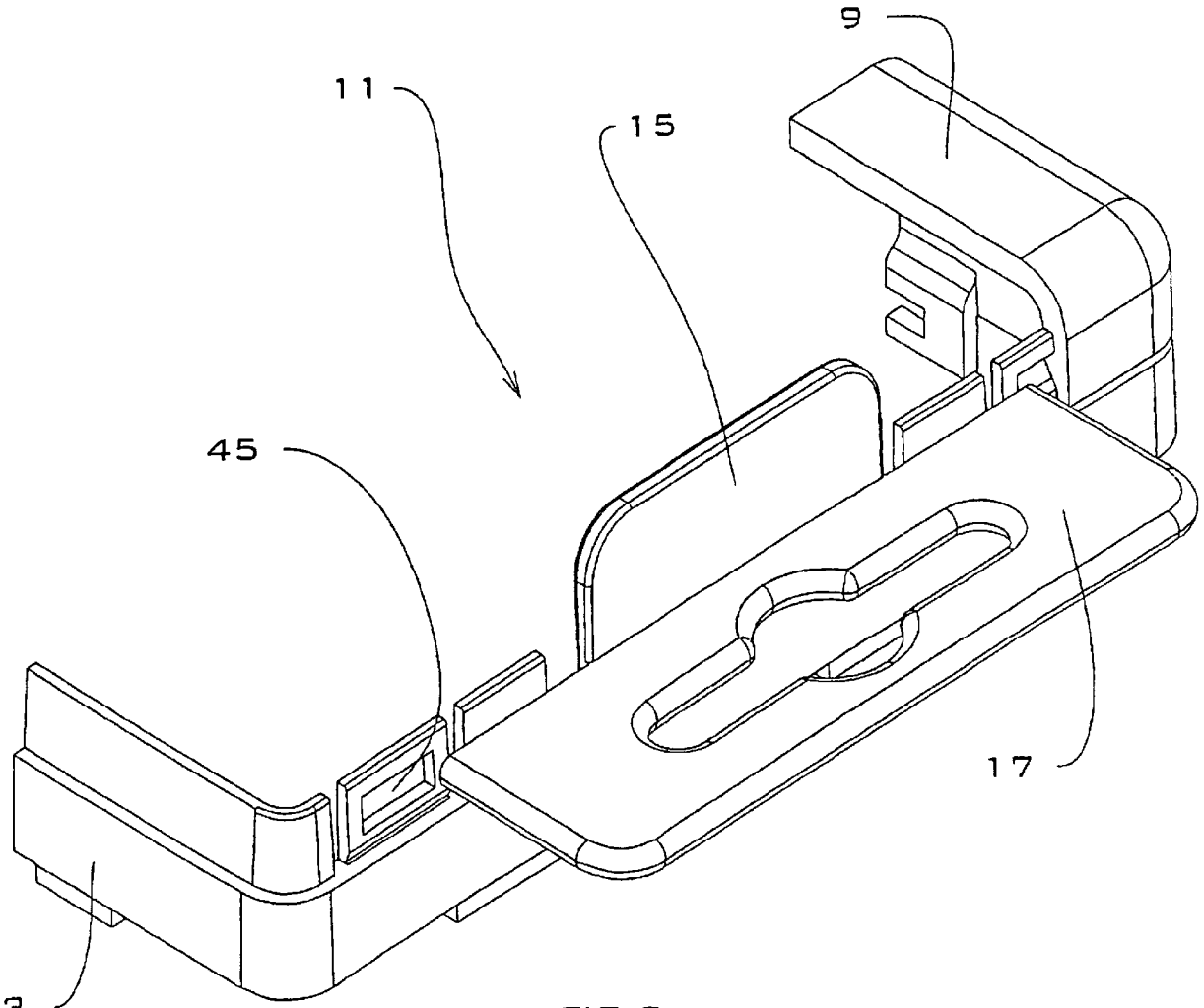
FIG. 9 is a detailed isometric view of the tamper prevention means of the tamper proof container of FIG. 1.
Figure 10:
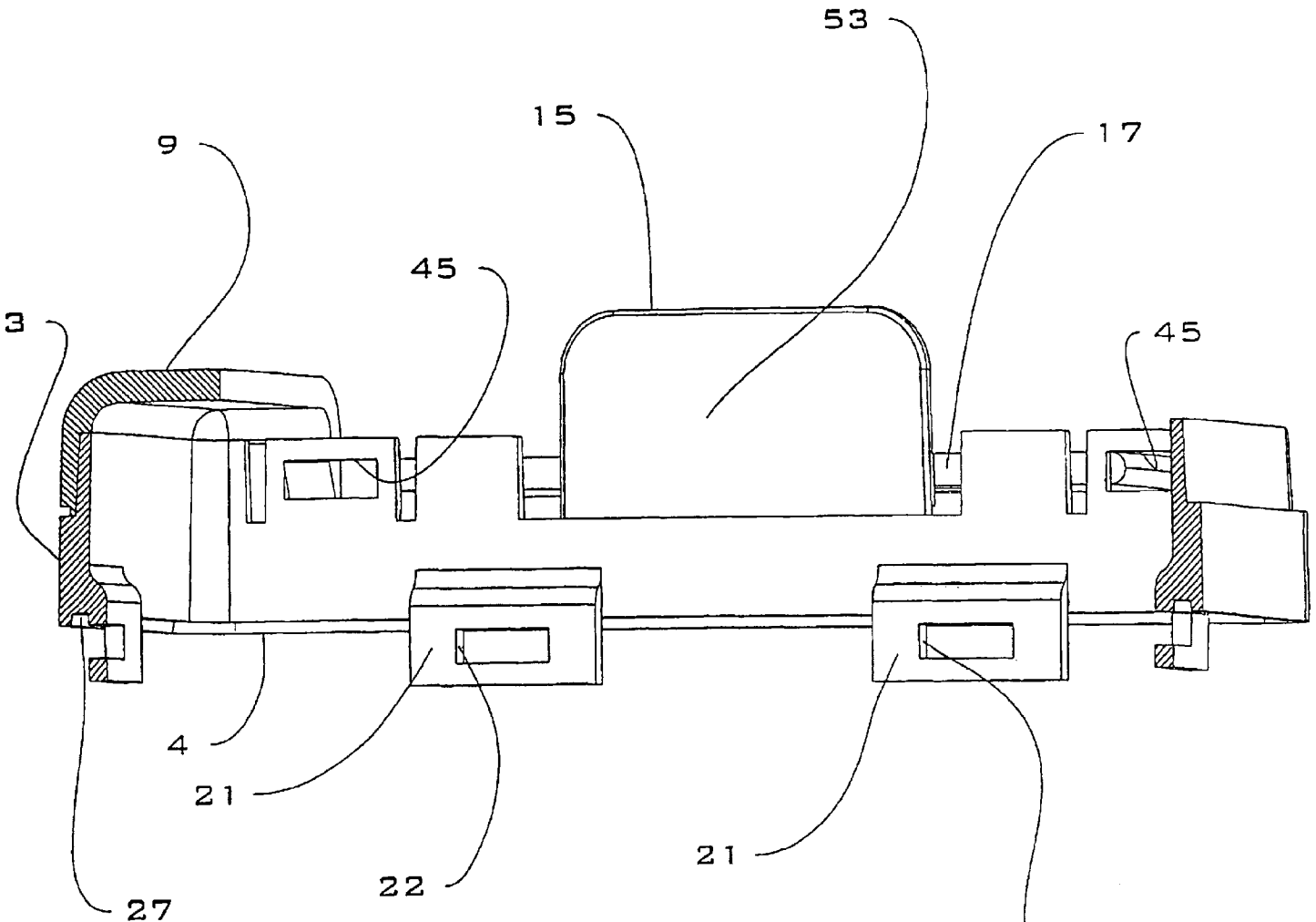
FIG. 10 is an isometric view of the opposing side of the tamper protection means of FIG. 9.

FIGS. 9 to 11 more clearly show the tamper prevention means 11 of the present invention. The locking element 15 of the tamper prevention means 11 is secured to the second half casing 5 by a frangible connection 51. The locking element 15 further includes an inclined inner surface 53 which is adapted to the located in a closely adjacent or abutting relationship with the peripheral lip 35 of the slide cover 9.

The cover 9 is initially installed over the access opening 7 with the locking element 15 in position. This is achieved by initially securing the engagement tung 37 of the slide cover 9 to the cooperating lug 45, with the slide cover 9 located at an angle away from the plane of the access opening 7. The peripheral lip 35 of the slide cover 9 rests against the inclined face 53 of the locking element 15. The frangible connection 51 provides a sufficient resilience to allow a slight deflection of the locking element 15 such that the peripheral lip 35 of the slide cover 9 can slide over the inclined face 53 down towards the final closed position of the slide cover 9. When the slide cover 9 is in that position, the male lugs 43 engage the cooperating apertures 45 on the first half casing 3 and the locking element 15 returns to its initial position. The slide cover 9 can only be removed from the container body 1 by moving it in a sliding motion parallel to the plane of the access opening 7. This is however not possible because the locking element 15 is blocking this motion. The only way that the cover 9 can be removed is therefore by removal of the locking element 15.

Figure 13:
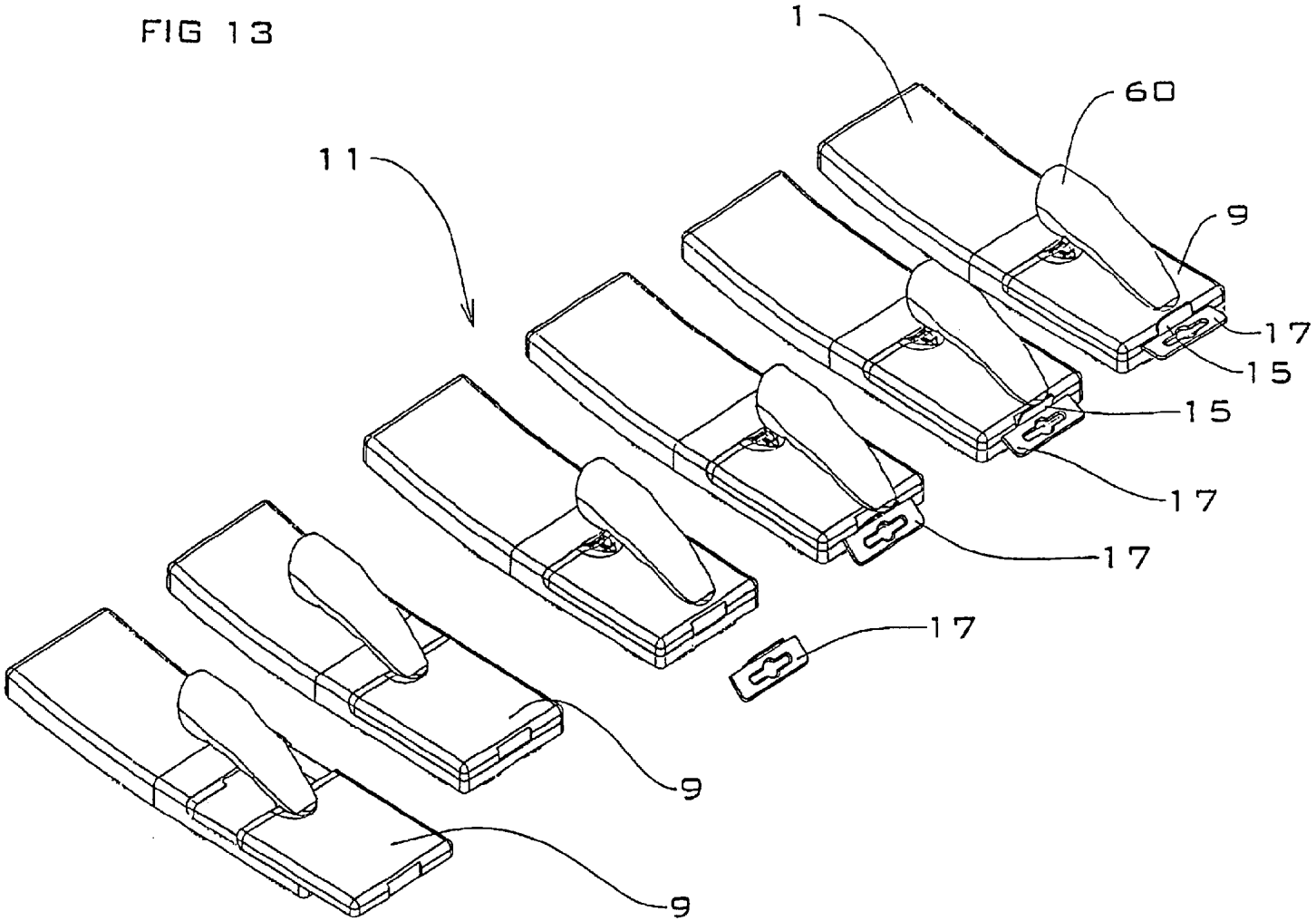
FIG. 13 are respective isometric views showing the sequence of operation of the tamper proof container as shown in FIG. 1.

FIG. 13 shows in more detail the operation sequence of the tamper proof container. Moving from right to left in FIG. 13, the person opening the container can use their finger 16 to apply a force on the locking element 15. Because the locking element 15 is secured by a frangible connection 51 to the second half casing 5, the locking element 15 and associated product hanging tag 17 can be broken off the rest of the container body 1. The removal of the locking element 15 then allows for the opening of the slide cover 9 with the person applying finger pressure to the finger depression 47 of the cover 9 to release the engagement tung 37 from the cooperating lug 45 and subsequently sliding the slide cover 9 in a direction parallel to the plane of the access opening 7 to open said access opening.

The product tag 17 is used to hang the container within a shop display. Therefore, the removal of the locking element 15 and associated support tag 17 provides a clear visual indication of the tampering or opening of the container. Furthermore, the container body is produced using relatively rigid thermoplastic such as ABS or related thermoplastic materials. This means that the snap connection 19 interconnecting the first and second half casings 3, 5 cannot be separated by the application of opposing forces on either side of the container body 1. This prevents any gap being formed at the junction 2 by the application of this force. This interaction, together with the cooperation of the first half casing peripheral edge 4 and the second half casing peripheral edge 6 as shown in FIGS. 11 and 12 ensure that it is not possible to gain access to the contents of the container using a hypodermic needle through the junction 2. The plastic is also of sufficient density to prevent the hypodermic needle penetrating through any of the walls of the container body or slide cover 9.

FIGS. 14 to 30 shows a second preferred embodiment of a tamper proof container according to the present invention. The principle of operation of this second preferred embodiment is identical to that of the first preferred embodiment as shown in FIGS. 1 to 13. The second embodiment is however specifically adapted for tablet sheets of the type used to package drug capsules or tablets.

Figure 14:
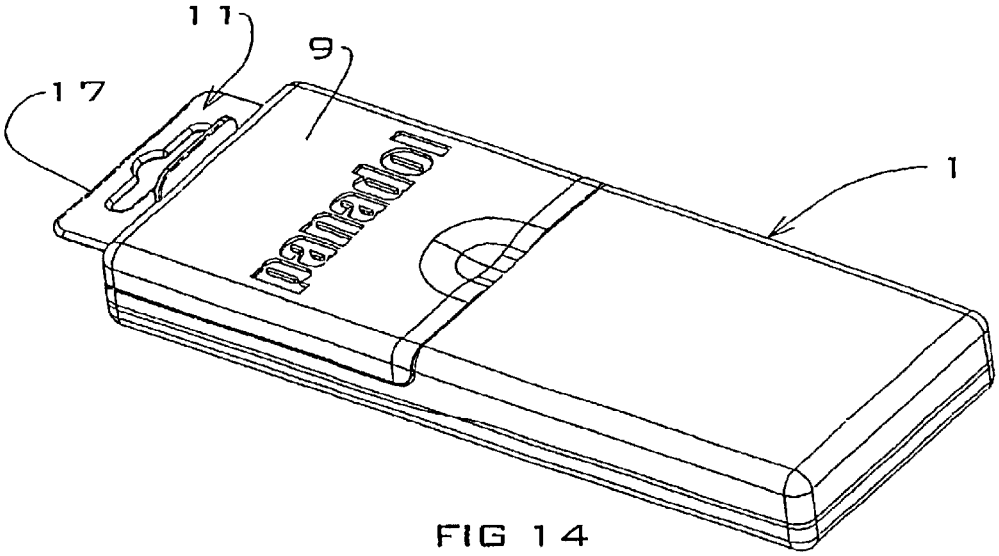
FIG. 14 is an isometric view of a second preferred embodiment of a tamper proof container according to the present invention.
Figure 15:
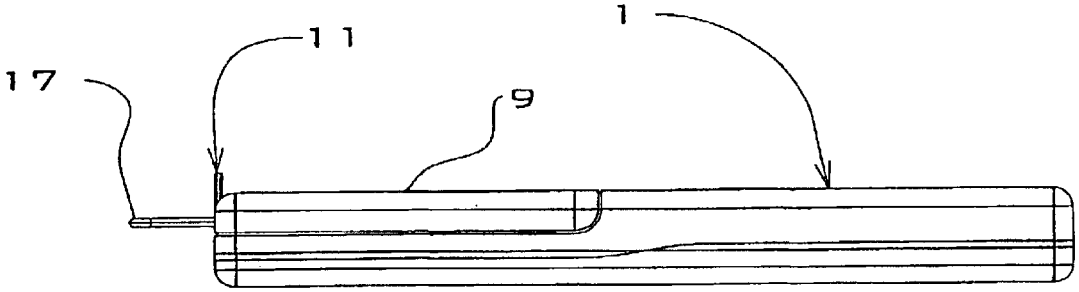
FIG. 15 is a side view of the tamper proof container of FIG. 14.
Figure 16:
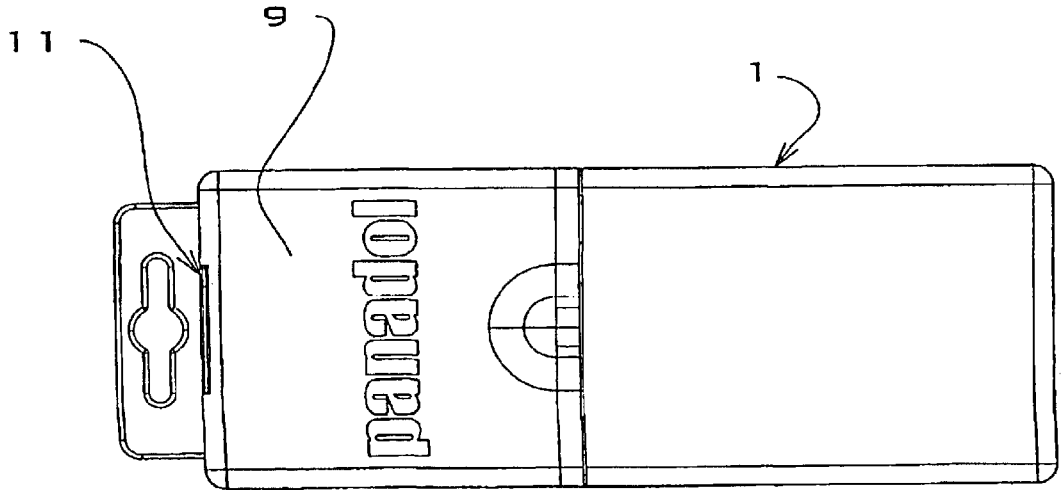
FIG. 16 is a plan view of the tamper proof container of FIG. 14.
Figure 17:
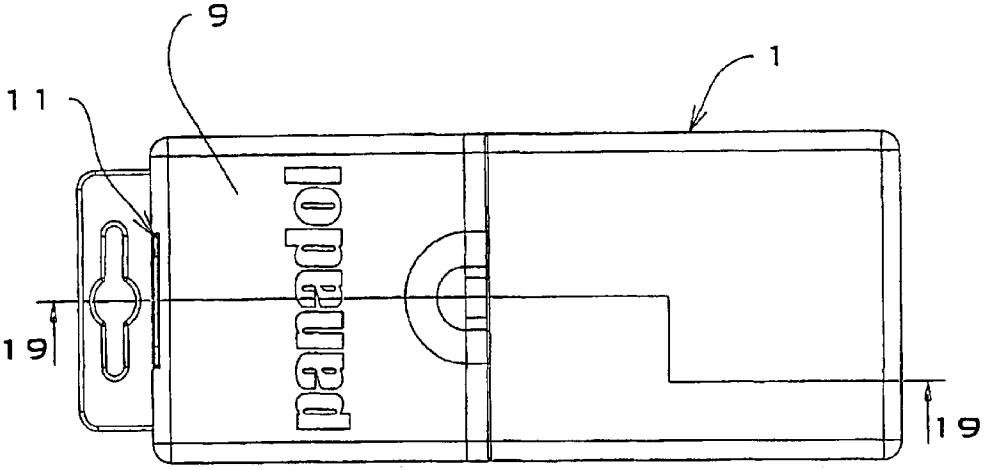
FIG. 17 is a plan view of the tamper proof container of FIG. 14 showing section line 19—19.
Figure 18:
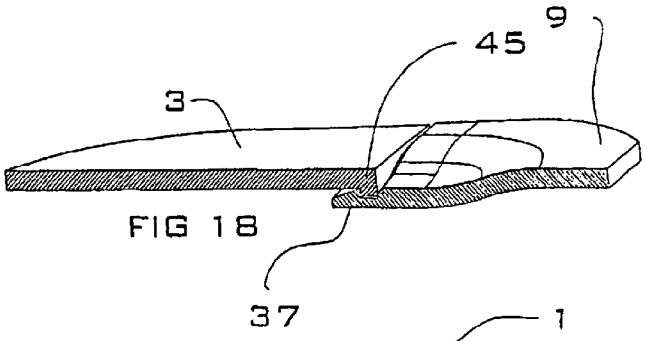
FIG. 18 is a detailed cross-sectional view showing the engagement of the slide cover to the container body of the tamper proof container of FIG. 14.
Figure 19:
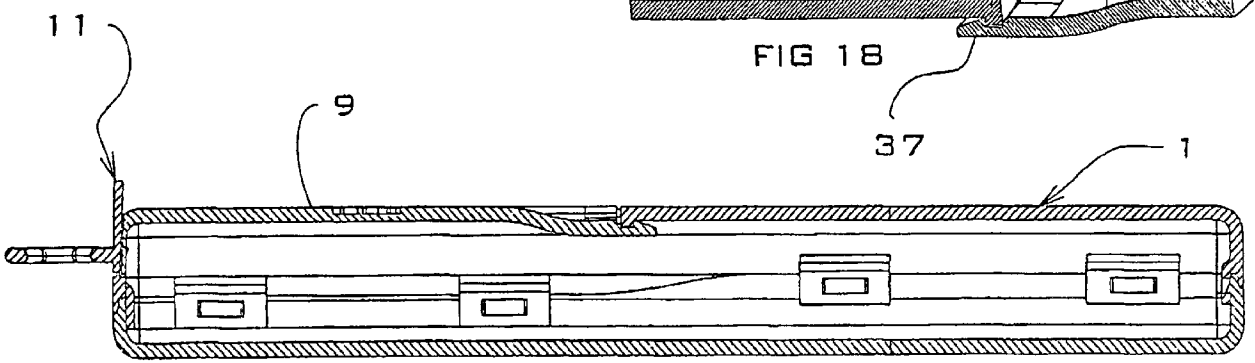
FIG. 19 is a cross-sectional view taken along line 19—19 of FIG. 17.
Figures 20, 21:
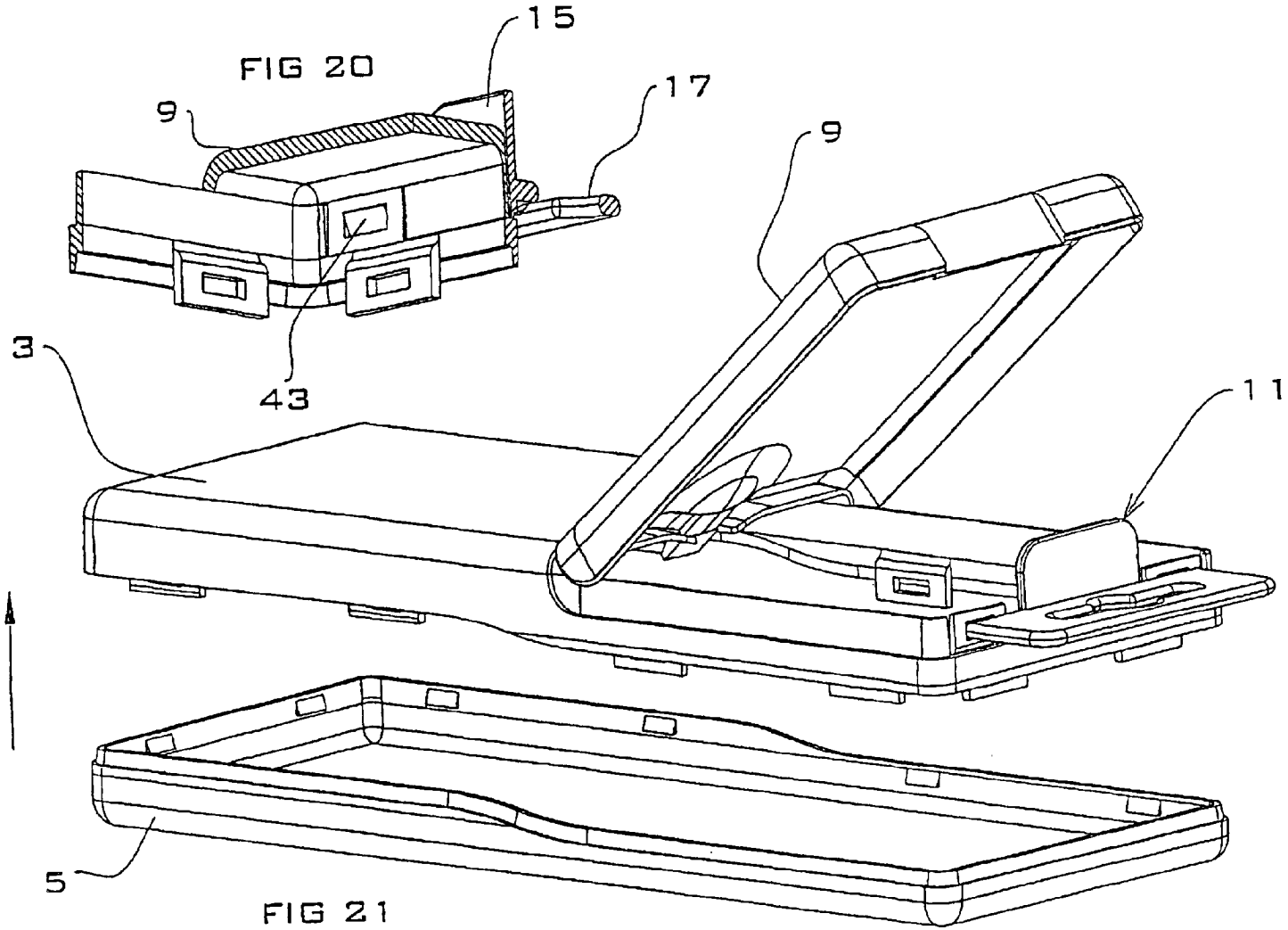
FIG. 20 is a detailed cross-sectional view of the tamper protection means of the tamper proof container of FIG. 14.
FIG. 21 is a partially exploded isometric view of the tamper proof container of FIG. 14.
Figures 25, 26, 27, 28, 29, 30:
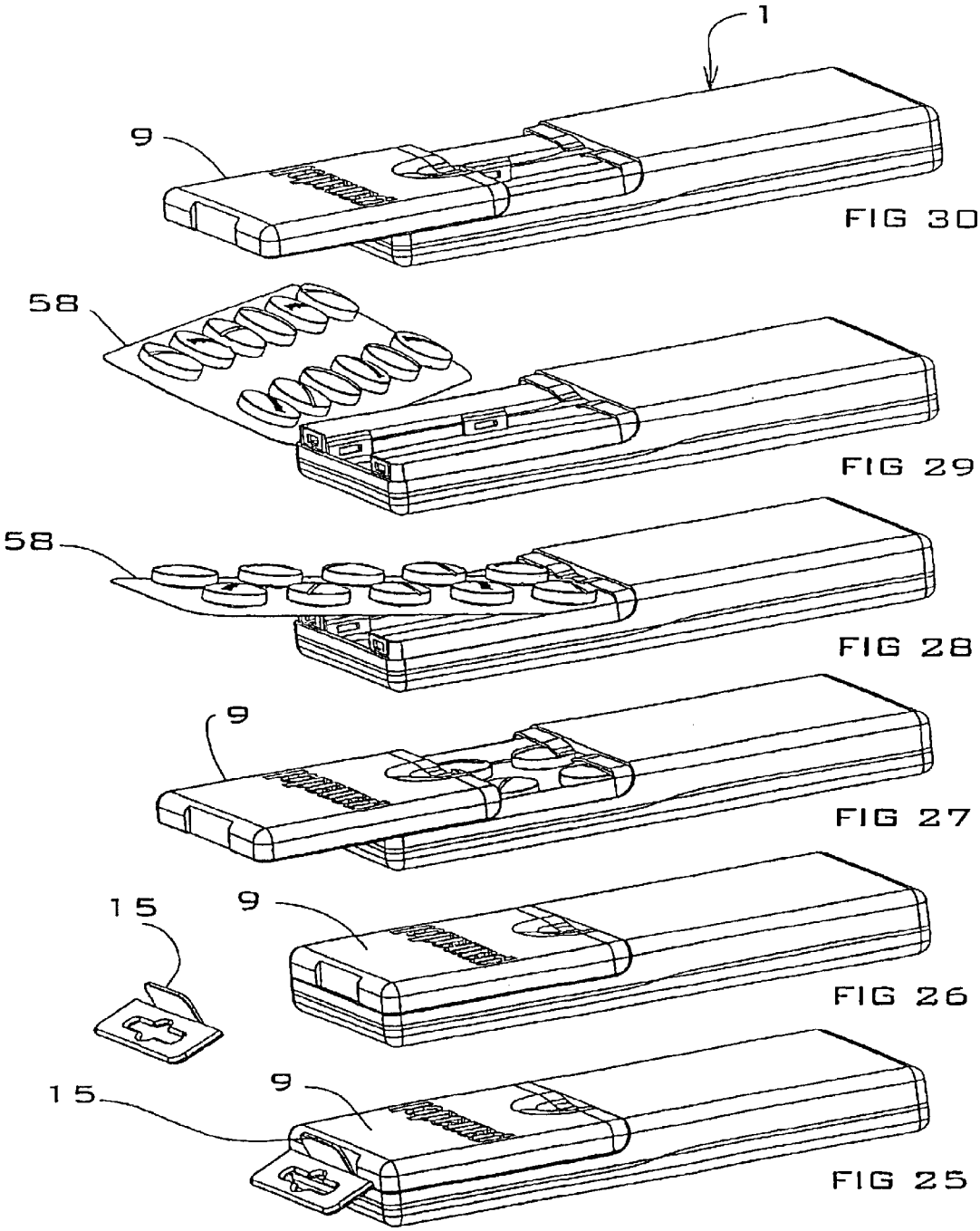
FIGS. 25 to 30 are respective isometric views showing the sequence of operation of the tamper proof container as shown in FIG. 14.

Referring initially to FIGS. 14 to 16, the second preferred embodiment of the tamper proof container has a flatter and thinner profile than the first preferred embodiment shown in FIGS. 1 to 13. However, as shown in FIGS. 17 to 30, the operation of the second preferred embodiment of the tamper proof container according to the present invention operates in an identical fashion with the cover 9 being held in position by a locking tab 15. Removal of the locking tab 15 as shown in the sequence of FIGS. 25 to 30 allows for the separation of the cover 9 from the container body 1 thereby allowing access into the contents of the tamper proof container shown as tablet sheets 58.

FIGS. 31 to 49 show a third preferred embodiment of a tamper proof container according to the present invention. This tamper proof container is similar in shape to that of the second embodiment shown in FIGS. 14 to 30. The tamper prevention means and the cover engagement means for engaging the cover 9 to the container body 1 is however somewhat different.

Figure 31:
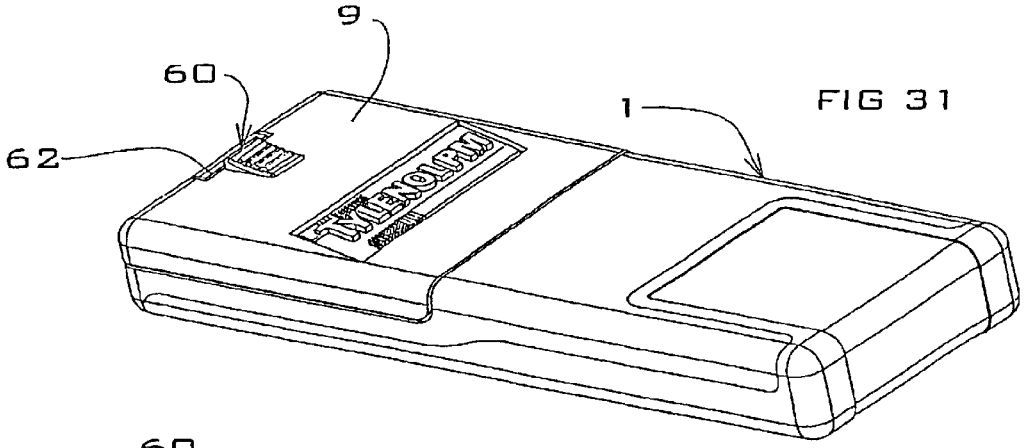
FIG. 31 is an isometric view of a third preferred embodiment of a tamper proof container according to the present invention.
Figure 32:
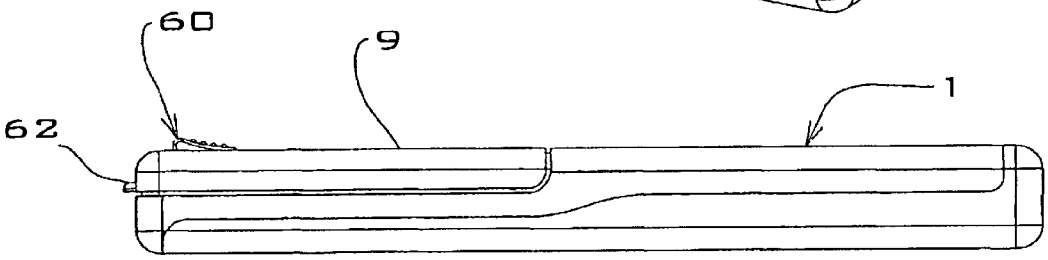
FIG. 32 is a side view of the tamper proof container of FIG. 31.
Figure 33:
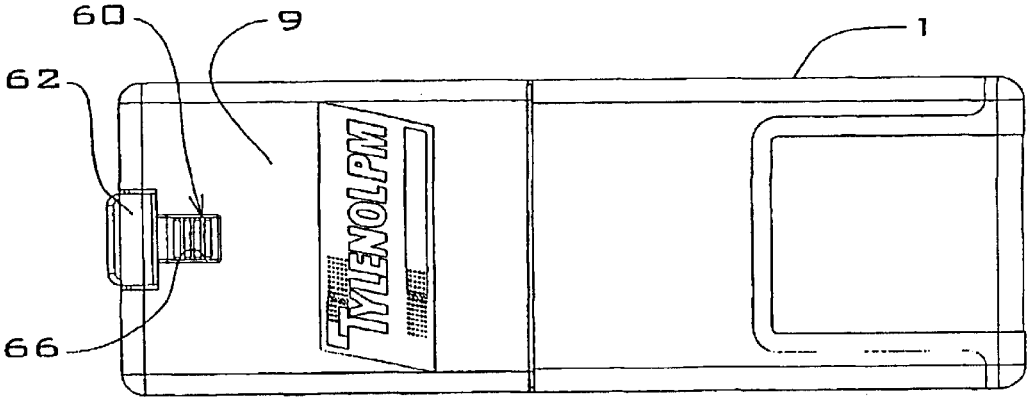
FIG. 33 is a plan view of the tamper proof container of FIG. 31.
Figure 34:
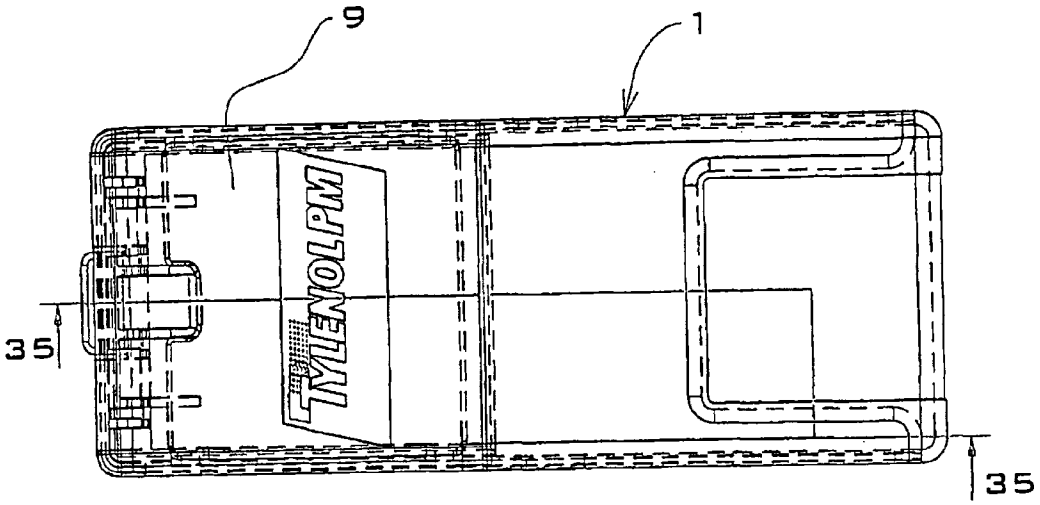
FIG. 34 is a plan view of the tamper proof container of FIG. 31 showing section line 35—35.
Figure 35:
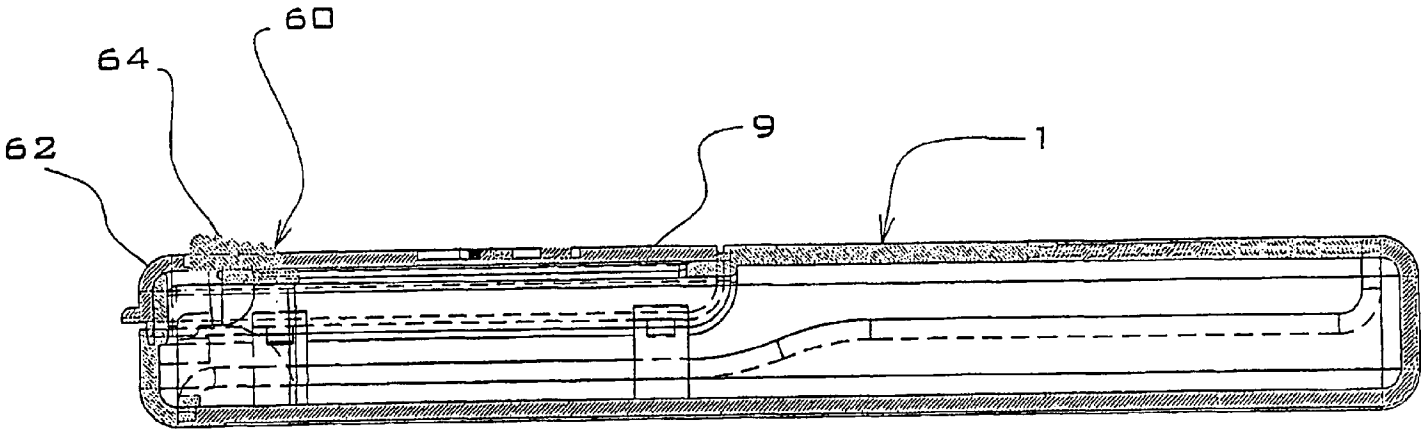
FIG. 35 is a cross-sectional view of the tamper proof container of FIG. 34 taken along line 35—35.
Figure 36:
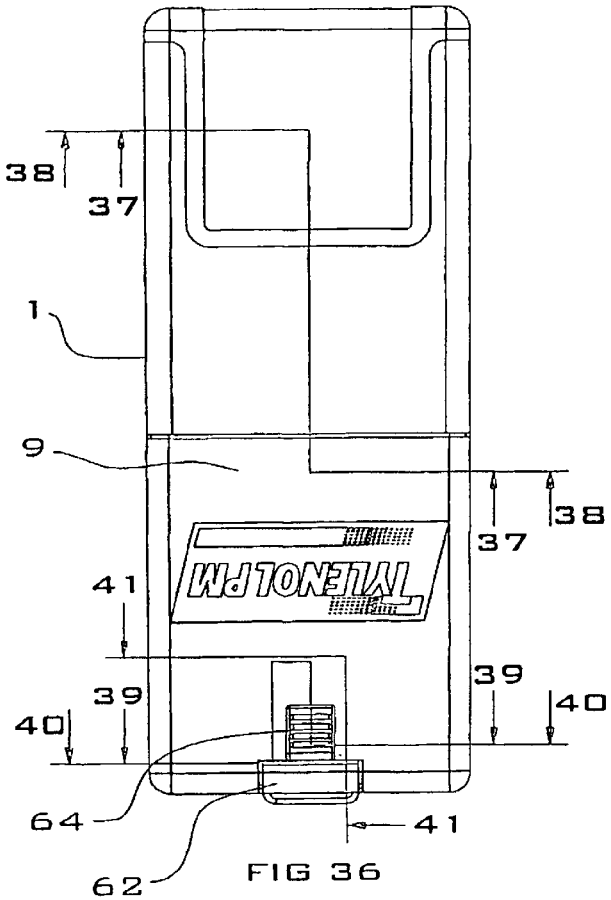
FIG. 36 is a plan view of the tamper proof container of FIG. 31 showing section lines 37—37, 38—38, 39—39, 40—40, and 41—41.
Figure 37:
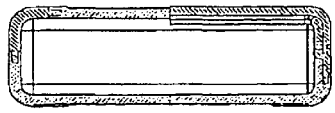
FIG. 37 is a cross-sectional view of the tamper proof container of FIG. 36 taken along line 37—37.
Figure 38:
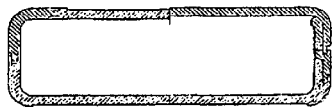
FIG. 38 is a cross-sectional view of the tamper proof container of FIG. 36 taken along line 38—38.
Figure 39:
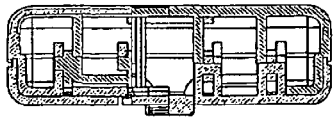
FIG. 39 is a cross-sectional view of the tamper proof container of FIG. 36 taken along line 39—39.
Figure 40:
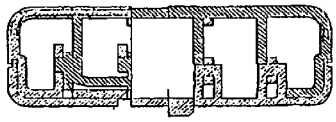
FIG. 40 is a cross-sectional view of the tamper proof container of FIG. 36 taken along line 40—40.

FIGS. 31 to 33 show that the third preferred embodiment of the container has a similar flat profile to the second embodiment. However, unlike the preceding embodiments, the engagement means for the cover 9 is provided by a manual actuator mechanism 60. Furthermore, the tamper prevention means is provided by a locking tab 62 which forms part of the cover 9.

FIGS. 34 to 49 show in more detail the operation of both the manual actuator mechanism 60 and the locking tab 62 of the tamper prevention means. The manual actuator mechanism includes a latch 64 that extends through an opening 66 provided in the cover 9 (best shown in FIG. 48). The manual actuator mechanism 60 further includes a pair of resilient supports 68 (best shown in FIGS. 47 and 48). The resilient support 68 provides a biasing for the latch 64. The manual actuator mechanism 60 further includes a number of lugs 70 which engage apertures 72 provided in respective tags 71 extending from an interior face of the cover 9. When the cover is located over the access opening of the container body 1, the lugs 70 engage the apertures 72 of the cover 9 thereby holding the cover in position on the container body 1. The resilient supports 68 act to urge the lugs 70 into engagement with the cooperating apertures 72 of the cover 9.

The locking tabs 62 is integrally formed with the cover 9 and is located and forms one side of the opening 66 through which the latch 64 extends. The locking tab 62 is connected by a thin wall section frangible portion. 63 to the rest of the cover 9.

Figure 48:
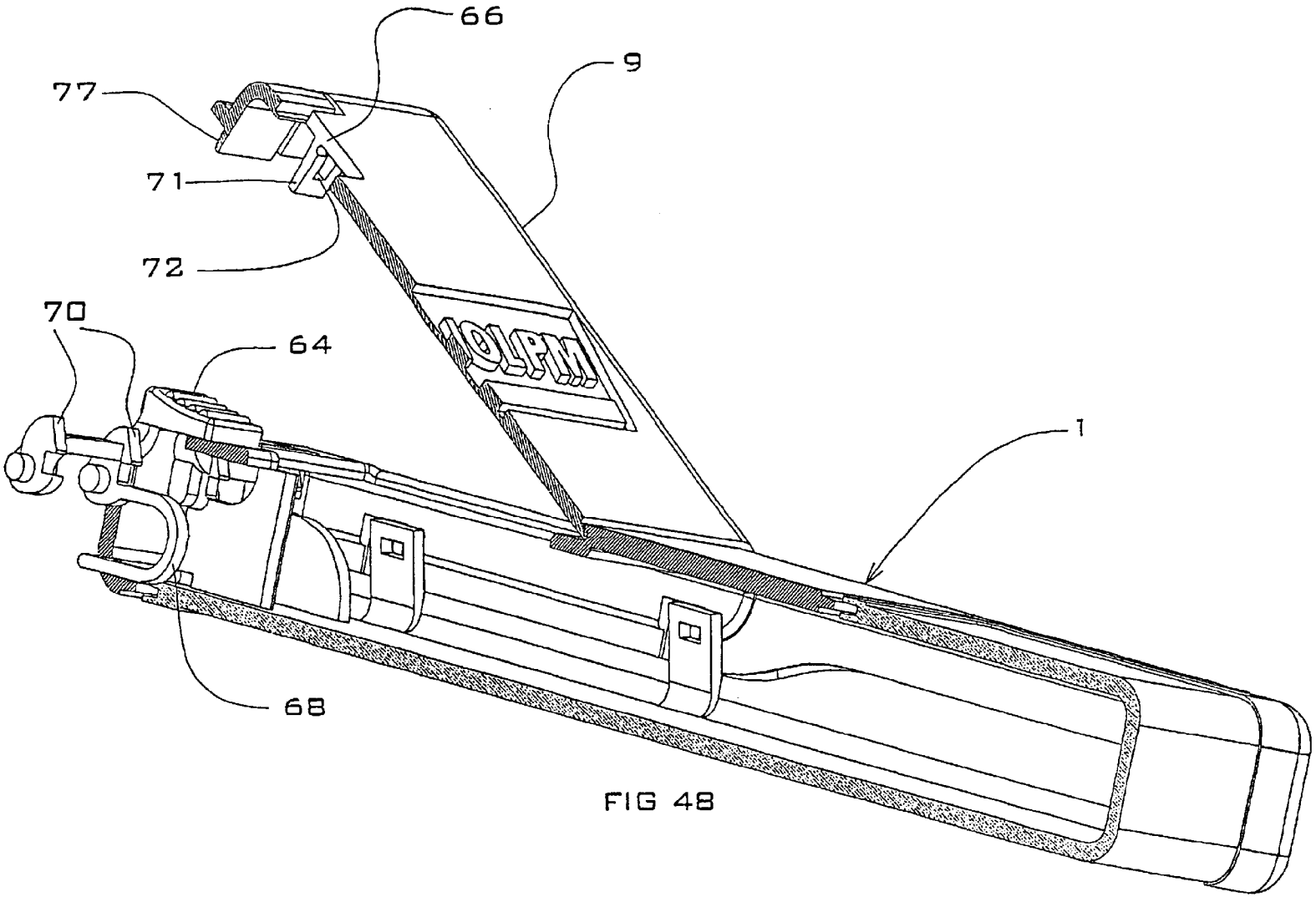
FIG. 48 is a further cross-sectional view of the tamper proof container of FIG. 31.
Figure 49:
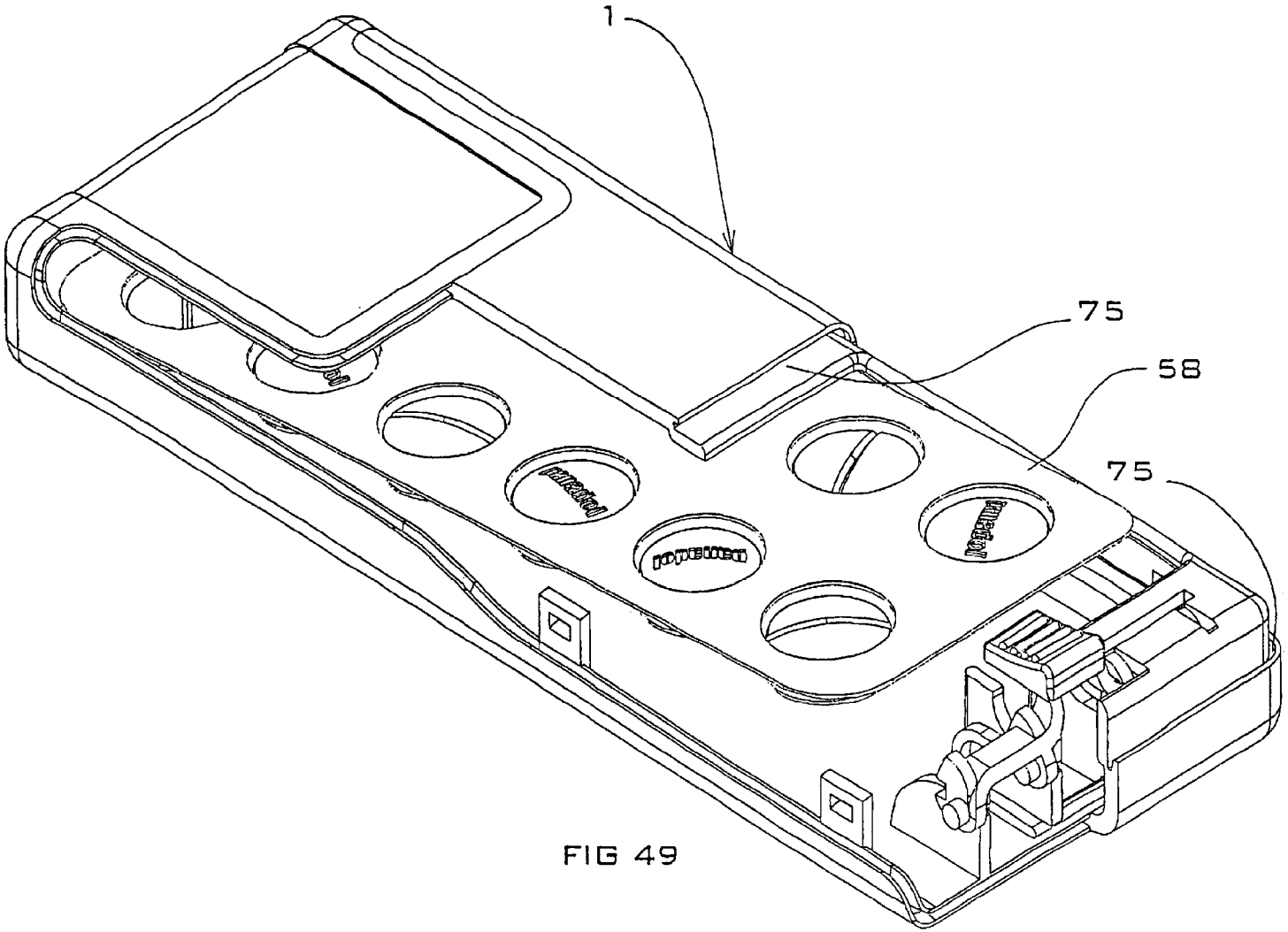
FIG. 49 is an isometric cross-sectional view of the tamper proof container of FIG. 31 showing a tablet sheet located therein.

As best shown in FIGS. 48 and 49, the cover 9 includes a peripheral rib 77 extending along the periphery of the cover 9. This peripheral rib 77 engages a cooperating groove 75 provided in the container body 1, therefore when the cover 9 is located over the access opening of the container body 1, the peripheral rib 77 of the cover 9 is located in the cooperating groove 75 of the container body. This arrangement further assists in locating the cover 9 on the container body 1 while further restricting the access of any needle into the container through the join line between the container body 1 and the cover 9.

Figures 41, 42, 43, 44, 45, 46:
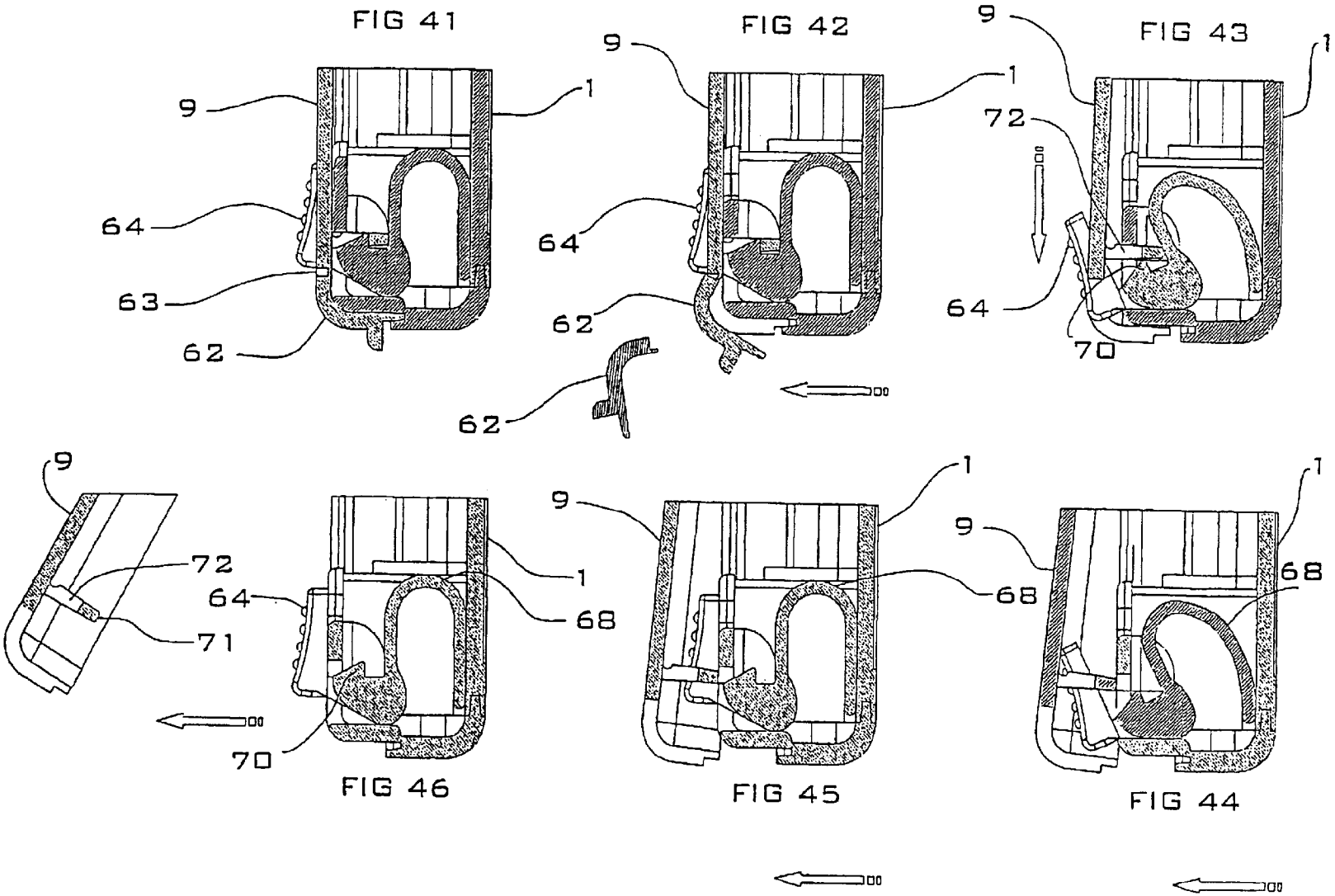
FIGS. 41 to 46 are detailed cross-sectional views showing the operation of the tamper prevention means of the tamper proof container of FIG. 31.
Figure 47:
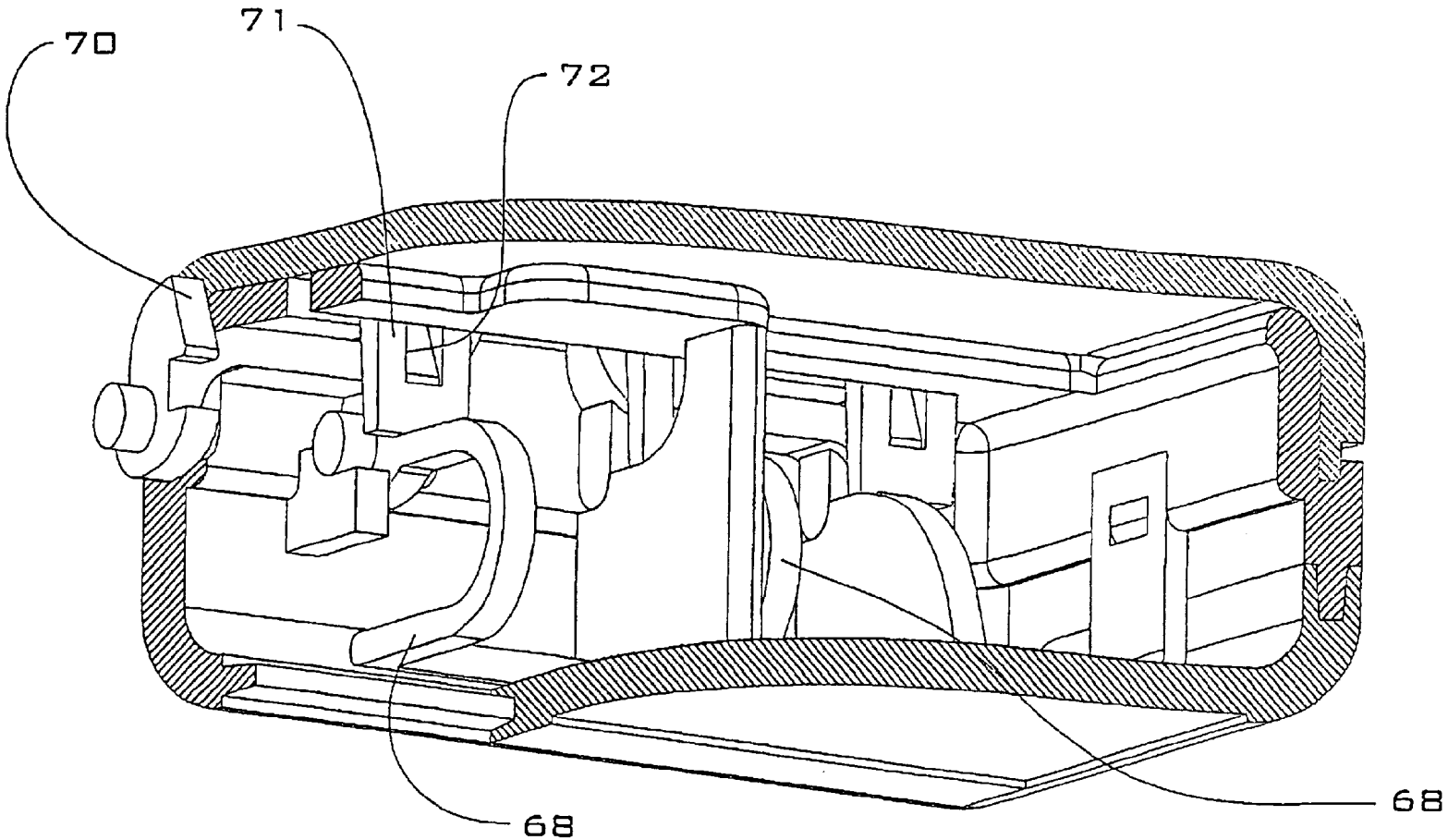
FIG. 47 is a detailed cross-sectional view showing the manual actuator mechanism of the tamper proof container of FIG. 31.

FIGS. 41 to 46 show the sequence of operation of the tamper prevention means. As shown in FIG. 42, the locking tab 62 can be separated from the rest of the cover 9. This therefore frees the latch 64 for movement as shown in FIG. 43. The movement of the latch 64 releases the lugs 70 from the cooperating apertures 72 of the cover. The cover 9 can then be separated from the rest of the container body as sequentially shown in FIGS. 44 to 46.

The separation of the locking tab 62 from the cover 9 would provide an indication of the possibility of the tampering of the contents of the tamper proof container. After the locking tab 62 has been removed from the cover 9, the manual actuator mechanism 60 can still act to securely retain the cover 9 on the container body 1. The cover 9 can be simply removed by displacement of the latch 64 as previously described.

Modifications and variations as would be deemed obvious to the person skilled in the art are included within the ambit of the present invention as defined in the appended claims.

What is claimed is:

1. A tamper proof container comprising:

a container body within which product can be accommodated, the container body having an access opening;

a cover separable from the container body for closing the access opening and including engagement means for engaging the container body when over the access opening; and tamper prevention means for preventing removal of the cover when located over the access opening, the tamper prevention means including at least one locking element;

wherein the locking element(s) is adapted to allow an initial engagement of the cover to the container body over the access opening while preventing subsequent removal therefrom;

and wherein the locking element(s) is separable from the container, the separation of the locking element(s) allowing the removal of the cover from the container body, the removal of the locking element(s) further providing a visual indication that the container has been opened.

2. A tamper proof container according to claim 1, wherein the access opening is provided in a wall(s) of the container body, and the engagement means of the cover provides a releasable engagement of the cover to the container body when located over the access opening, the cover being at least substantially flush with the wall(s) when engaged with the container body.

3. A tamper proof container according to claim 2, wherein the cover includes a peripheral lip extending along at least a portion of the periphery thereof, the peripheral lip being adapted to engage a cooperating shoulder in the container body located adjacent to the access opening.

4. A tamper proof container according to claim 3, wherein the cover is in the form of a slide cover slidably supportable over the access opening, the engagement of the peripheral lip of the slide cover on the cooperating shoulder of the container body allowing slide motion of the slide cover relative to the access opening, the engagement means for the slide cover including one or more tungs located at one end of the slide cover, the or each tung respectively engaging a cooperating lug on the container body, the or each said lug being provided on an internal surface of the container body adjacent the access opening.

5. A tamper proof container according to claim 4, wherein the engagement means of the container slide cover further includes one or more lugs and one or more cooperating apertures respectively provided on an inner face of the peripheral lip of the cover at an opposing end of the slide cover to the tung(s) or in the container body adjacent the access opening, the lug(s) being accommodated within the aperture when the slide cover completely closes the access opening.

6. A tamper proof container according to claim 5, wherein the locking element of the tamper prevention means includes a locking tab extending from the container body adjacent the access opening, the locking tab extending at least substantially perpendicular relative to the plane of the access opening to thereby block the movement of the slide cover thereby preventing separation of the slide cover from the container body.

7. A tamper proof container according to claim 6, wherein the locking tab is attached to the rest of the container body by a frangible connection portion thereof.

8. A tamper proof container according to claim 7, wherein the locking tab is integrally formed with the container body with a relatively thin wall section between the locking tab and the rest of the container wall to provide the frangible connection portion for the locking tab.

9. A tamper proof container according to claim 8, wherein the locking tab includes a contact face located on a side of the locking tab facing the access opening, the contact face being inclined at an acute angle relative to the plane of the access opening.

10. A tamper proof container according to claim 7, wherein a means for hanging the container extends from the locking tab.

11. A tamper proof container according to claim 3, wherein the engagement means for the cover includes a peripheral rib extending along at least a portion of the periphery of the cover, the peripheral rib being locatable within a cooperating groove in the container body.

12. A tamper proof container according to claim 11, wherein the engagement means of the cover further includes one or more tags extending from an inner face of the cover, said tag(s) forming part of a coupling arrangement for engaging the cover to the container body.

13. A tamper proof container according to claim 12, wherein the coupling arrangement includes an aperture provided in the tag(s) for engaging a cooperating lug provided within the container body.

14. A tamper proof container according to claim 13, wherein the lug(s) are resiliently biased and supported on a manual actuator mechanism for allowing the release of the lug(s) from the cooperating tag thereby allowing the removal of the cover from the container body.

15. A tamper proof container according to claim 14, the manual actuator mechanism including a biased latch, whereby movement of the latch disengages the coupling mechanism.

16. A tamper proof container according to claim 15, wherein the locking element of the tamper prevention means is provided on the cover, the locking element preventing movement of the latch thereby preventing the release of the cover from the container body.

17. A tamper proof container according to claim 16, wherein the locking element includes a locking tab located immediately adjacent the latch, the locking tab being connected to the cover by a frangible connection.

18. A tamper proof container according to claim 17, wherein the locking tab is integrally formed with the cover with a relatively thin wall section between the locking tab and the rest of the cover to provide a frangible connection portion for the locking tab.

19. A tamper proof container according to claim 1, wherein the container body is made of two casing shells, a series of female snap tungs being provided along the peripheral edge of one casing shell, and a series of cooperating males lugs being provided adjacent the peripheral edge of the other casing shell to enable an interconnection between the casing shells.

20. A tamper proof container according to claim 19, wherein a rib is provided along the peripheral edge of one of the casing shells, and a cooperating shoulder or channel is provided along the peripheral edge of the other casing shell, wherein when the two casing shells are brought together, the rib can be accommodated by the shoulder or rib.

* * * * *